US010522095B2

(12) United States Patent
Yata et al.

(10) Patent No.: US 10,522,095 B2
(45) Date of Patent: Dec. 31, 2019

(54) DISPLAY DEVICE

(71) Applicant: Japan Display Inc., Tokyo (JP)

(72) Inventors: Tatsuya Yata, Tokyo (JP); Takayuki Nakanishi, Tokyo (JP); Masaya Tamaki, Tokyo (JP)

(73) Assignee: Japan Display Inc., Tokyo (JP)

( * ) Notice: Subject to any disclaimer, the term of this patent is extended or adjusted under 35 U.S.C. 154(b) by 198 days.

(21) Appl. No.: 15/246,100

(22) Filed: Aug. 24, 2016

(65) Prior Publication Data

US 2017/0061903 A1 Mar. 2, 2017

(30) Foreign Application Priority Data

Aug. 31, 2015 (JP) ..... 2015-170697

(51) Int. Cl.
*G09G 3/34* (2006.01)
*G09G 3/36* (2006.01)
*G09G 3/3208* (2016.01)

(52) U.S. Cl.
CPC ..... *G09G 3/3413* (2013.01); *G09G 3/3208* (2013.01); *G09G 3/3607* (2013.01); *G09G 2320/0233* (2013.01); *G09G 2320/0686* (2013.01); *G09G 2360/144* (2013.01)

(58) Field of Classification Search
None
See application file for complete search history.

(56) References Cited

U.S. PATENT DOCUMENTS 6,924,792 B1 * 8/2005 Jessop ..... G02B 26/004 345/105
10,036,847 B2 * 7/2018 Nichol ..... G02B 6/0028
2004/0263045 A1 * 12/2004 Smith ..... H01L 27/3211 313/373
2005/0123229 A1 * 6/2005 Huck ..... G02B 6/0056 385/11
2006/0146038 A1 * 7/2006 Park ..... G06F 3/0412 345/173

(Continued)

FOREIGN PATENT DOCUMENTS

JP 2013-218057 A 10/2013
JP 2013-222515 A 10/2013

*Primary Examiner* — Parul H Gupta
(74) *Attorney, Agent, or Firm* — Michael Best & Friedrich LLP

(57) ABSTRACT

According to an aspect, a display device includes a display unit, an illumination unit, a measurement unit, and a control unit. When pixels that are expected to perform display output at identical luminance are adjacent to each other in adjacent partial regions, and when a difference in the intensity of the internal light between light emitting regions corresponding to the adjacent partial regions is equal to or larger than a predetermined threshold, the control unit performs correction to increase luminance of a predetermined number of pixels belonging to a first partial region corresponding to a first light emitting region the intensity of the internal light from which is lower among the adjacent partial regions. The predetermined number of pixels are located closer to a second partial region corresponding to a second light emitting region the intensity of the internal light from which is higher among the adjacent partial regions.

7 Claims, 31 Drawing Sheets

(56) References Cited

U.S. PATENT DOCUMENTS

| | | | | |
|---|---|---|---|---|
| 2009/0262066 | A1* | 10/2009 | Oke | G09G 3/3426 345/102 |
| 2012/0182276 | A1* | 7/2012 | Kee | G09G 5/10 345/207 |
| 2014/0264034 | A1* | 9/2014 | Cui | G06F 3/0416 250/341.8 |
| 2015/0253487 | A1* | 9/2015 | Nichol | G02B 6/0036 362/610 |
| 2018/0059318 | A1* | 3/2018 | Nichol | G02B 6/0028 |

* cited by examiner

FIG.13

| | DEFINITION OF WHITE POINT OF INPUT SIGNAL | WHITE POINT | CORRECTED GRADATION VALUE OF WHITE |
|---|---|---|---|
| (HIGH) COLOR COMPONENT (LOW) | R G B | R G B | R G B |
| RGB GRADATION VALUE | 255,255,255 | 255,204,204 | 255,204,204 |
| R:G:B RATIO | 1:1:1 | 1:0.8:0.8 | 1:0.8:0.8 |

FIG.14

| | INPUT SIGNAL | WHITE POINT | LUMINANCE MAGNIFICATION (N) | REQUIRED LUMINANCE VALUE |
|---|---|---|---|---|
| (HIGH) COLOR COMPONENT (LOW) | R G B | R G B (1:0.8:0.8) | ×2 | R G B |
| EXPRESSION | | | | |
| R | 180 | ×1 | ×2 | =360 |
| G | 225 | ×0.8 | ×2 | =360 |
| B | 80 | ×0.8 | ×2 | =128 |

FIG.15
| | REQUIRED LUMINANCE VALUE | MAXIMUM REFLECTION LUMINANCE DUE TO EXTERNAL LIGHT | COMPENSATION REQUIRED LUMINANCE (Rf,Gf,Bf) |
|---|---|---|---|
| (HIGH) COLOR COMPONENT (LOW) | 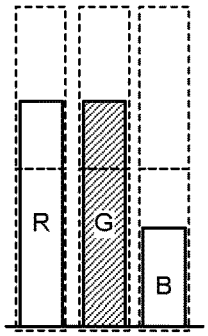  | 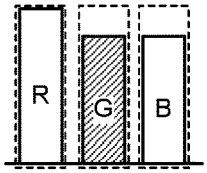  | 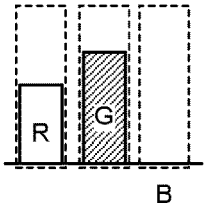  |
| EXPRESSION | | | |
| R | 360 | -255 | =105(Rf) |
| G | 360 | -204 | =156(Gf) |
| B | 128 | -204 | =0(Bf) |
FIG.16
| UNIT OF PROCESSING | REQUIRED LUMINANCE VALUE OF UNIT PIXEL | | | COMPENSATION REQUIRED LUMINANCE | | | FLMAX | INTERNAL LIGHT INTENSITY |
|---|---|---|---|---|---|---|---|---|
| | Rt | Gt | Bt | Rf | Gf | Bf | | |
| $U_1$ | 360 | 360 | 128 | 105 | 156 | 0 | 0.61 | 0.61 |
| | 300 | 300 | 100 | | | | | |
| | 200 | 200 | 50 | | | | | |
| | 100 | 100 | 25 | | | | | |
| | 50 | 50 | 0 | | | | | |
| | ⋮ | ⋮ | ⋮ | | | | | |
| $U_2$ | 360 | 250 | 100 | 105 | | | 0.41 | 0.61 |
| | 300 | 360 | 100 | | 156 | | 0.61 | |
| | 100 | 100 | 128 | | | 0 | 0 | |
| | 100 | 100 | 25 | | | | | |
| | 50 | 50 | 0 | | | | | |
| | ⋮ | ⋮ | ⋮ | | | | | |

FIG.17

| | REQUIRED LUMINANCE VALUE | INTERNAL LIGHT +EXTERNAL LIGHT | OUTPUT SIGNAL (O(R,G,B)) |
|---|---|---|---|
| (HIGH) COLOR COMPONENT (LOW) | R G B | R G B R G B | R G B |
| EXPRESSION | | | |
| R | 360 | /{(255+156)/255} | =223(O(R)) |
| G | 360 | /{(204+156)/255} | =255(O(G)) |
| B | 128 | /{(204+156)/255} | =91(O(B)) |

FIG.18

| UNIT OF PROCESSING | MAXIMUM REQUIRED LUMINANCE VALUE OF COLORS | | | INTERNAL LIGHT INTENSITY |
|---|---|---|---|---|
| | Rt | Gt | Bt | |
| $U_1$ | 360 | 360 | 128 | 0.61 |
| $U_2$ | 360 | 360 | 128 | 0.61 |
| $U_3$ | 360 | 128 | 128 | 0.41 |
| $U_4$ | 200 | 200 | 128 | 0 |
| ⋮ | ⋮ | ⋮ | ⋮ | ⋮ |

| UNIT OF PROCESSING | REQUIRED LUMINANCE VALUE OF UNIT PIXEL | | | INTERNAL LIGHT INTENSITY | OUTPUT SIGNAL | | |
|---|---|---|---|---|---|---|---|
| | Rt | Gt | Bt | | O(R) | O(G) | O(B) |
| $U_1$ | 360 | 360 | 128 | 0.61 | 223 | 255 | 91 |
| | 300 | 300 | 100 | | 186 | 213 | 71 |
| | 200 | 200 | 50 | | 124 | 141 | 35 |
| | 100 | 100 | 25 | | 62 | 71 | 18 |
| | 50 | 50 | 0 | | 31 | 35 | 0 |
| | ⋮ | ⋮ | ⋮ | | ⋮ | ⋮ | ⋮ |

FIG.23

| PARTIAL REGION | $F_1$ | | $F_2$ | | |
|---|---|---|---|---|---|
| LIGHT | EXTERNAL LIGHT | INTERNAL LIGHT | EXTERNAL LIGHT | INTERNAL LIGHT | |
| | YES | YES | YES | NO | |
| DISPLAY CONTENT | (Br) | | | | |
| GRADATION VALUE (BEFORE CORRECTION) | 0 0 0 (R G B) | | 0 0 0 (R G B) | 0 0 0 (R G B) | 0 0 0 (R G B) |
| GRADATION VALUE CORRECTION | NO | | YES | YES | NO |
| VISUALLY RECOGNIZED COLOR | e e e (R G B) | | e e e (R G B) | 0.6e 0.6e 0.6e (R G B) | 0 0 0 (R G B) |

FIG.24

| | V=1 | V=2 | V=3 | V=4 | V=5 | V=6 | V=7 | V=8 | V=9 | V=10 |
|---|---|---|---|---|---|---|---|---|---|---|
| | E=10 | E=8 | E=6 | E=4 | E=2 | E=0 | E=0 | E=0 | E=0 | E=0 |
| | E=10 | E=8 | E=6 | E=4 | E=2 | E=0 | E=0 | E=0 | E=0 | E=0 |
| | E=10 | E=8 | E=6 | E=4 | E=2 | E=0 | E=0 | E=0 | E=0 | E=0 |
| | E=10 | E=8 | E=6 | E=4 | E=2 | E=0 | E=0 | E=0 | E=0 | E=0 |
| | E=10 | E=8 | E=6 | E=4 | E=2 | E=0 | E=0 | E=0 | E=0 | E=0 |
| | E=10 | E=8 | E=6 | E=4 | E=2 | E=0 | E=0 | E=0 | E=0 | E=0 |
| $(A_1)$ | E=10 | E=8 | E=6 | E=4 | E=2 | E=0 | E=0 | E=0 | E=0 | E=0 |
| | E=10 | E=8 | E=6 | E=4 | E=2 | E=0 | E=0 | E=0 | E=0 | E=0 |
| | E=10 | E=8 | E=6 | E=4 | E=2 | E=0 | E=0 | E=0 | E=0 | E=0 |
| | E=10 | E=8 | E=6 | E=4 | E=2 | E=0 | E=0 | E=0 | E=0 | E=0 |

FIG.25

| ($A_1$) | V=1 | V=2 | V=3 | V=4 | V=5 | V=6 | V=7 | V=8 | V=9 | V=10 |
|---|---|---|---|---|---|---|---|---|---|---|
| W=1 | E=10 (1) | E=8 (0.8) | E=6 (0.6) | E=4 (0.4) | E=2 (0.2) | E=0 (0) | E=0 (0) | E=0 (0) | E=0 (0) | E=0 (0) |
| W=2 | E=8 (0.8) | E=7 (0.7) | E=6 (0.6) | E=4 (0.4) | E=2 (0.2) | E=0 (0) | E=0 (0) | E=0 (0) | E=0 (0) | E=0 (0) |
| W=3 | E=6 (0.6) | E=6 (0.6) | E=4 (0.4) | E=3 (0.3) | E=1 (0.1) | E=0 (0) | E=0 (0) | E=0 (0) | E=0 (0) | E=0 (0) |
| W=4 | E=4 (0.4) | E=4 (0.4) | E=3 (0.3) | E=2 (0.2) | E=0 (0) | E=0 (0) | E=0 (0) | E=0 (0) | E=0 (0) | E=0 (0) |
| W=5 | E=2 (0.2) | E=2 (0.2) | E=1 (0.1) | E=0 (0) | E=0 (0) | E=0 (0) | E=0 (0) | E=0 (0) | E=0 (0) | E=0 (0) |
| W=6 | E=0 (0) | E=0 (0) | E=0 (0) | E=0 (0) | E=0 (0) | E=0 (0) | E=0 (0) | E=0 (0) | E=0 (0) | E=0 (0) |
| W=7 | E=0 (0) | E=0 (0) | E=0 (0) | E=0 (0) | E=0 (0) | E=0 (0) | E=0 (0) | E=0 (0) | E=0 (0) | E=0 (0) |
| W=8 | E=0 (0) | E=0 (0) | E=0 (0) | E=0 (0) | E=0 (0) | E=0 (0) | E=0 (0) | E=0 (0) | E=0 (0) | E=0 (0) |
| W=9 | E=0 (0) | E=0 (0) | E=0 (0) | E=0 (0) | E=0 (0) | E=0 (0) | E=0 (0) | E=0 (0) | E=0 (0) | E=0 (0) |
| W=10 | E=0 (0) | E=0 (0) | E=0 (0) | E=0 (0) | E=0 (0) | E=0 (0) | E=0 (0) | E=0 (0) | E=0 (0) | E=0 (0) |

FIG.36

| PARTIAL REGION | $F_1$ | | $F_2$ | | |
|---|---|---|---|---|---|
| LIGHT | EXTERNAL LIGHT | INTERNAL LIGHT | EXTERNAL LIGHT | INTERNAL LIGHT | |
| | YES | ONLY R | YES | NO | |
| DISPLAY CONTENT | (Rr) | | | | |
| GRADATION VALUE (BEFORE CORRECTION) | 0 0 0 R G B | | 0 0 0 R G B | 0 0 0 R G B | 0 0 0 R G B |
| GRADATION VALUE CORRECTION | NO | | YES | YES | NO |
| VISUALLY RECOGNIZED COLOR | j 0 0 R G B | | j 0 0 R G B | 0.6j 0 0 R G B | 0 0 0 R G B |

FIG.37

| LIGHT EMITTING REGION | $F_1$ | | | $F_2$ | | |
|---|---|---|---|---|---|---|
| LIGHT SOURCE COLOR | R | G | B | R | G | B |
| LIGHT INTENSITY | 1 | 0 | 0 | 0 | 0 | 0 |
| DISPLAY CONTENT | (Rr) | | | | | |
| OUTPUT GRADATION VALUE OF UNIT PIXEL AT V=1 (BEFORE CORRECTION) | | | | R G B | | |
| | | | | 0,0,0 | | |

| LIGHT EMITTING REGION | $F_1$ | | | $F_2$ | | |
|---|---|---|---|---|---|---|
| LIGHT SOURCE COLOR | R | G | B | R | G | B |
| LIGHT INTENSITY | 1 | 0 | 0 | Lv | 0 | 0 |
| DISPLAY CONTENT | (Rr) | | | | | |
| OUTPUT GRADATION VALUE OF UNIT PIXEL AT V=1 (AFTER CORRECTION) | | | | R G B | | |
| | | | | 255,0,0 | | |

| PARTIAL REGION | $F_1$ | | | $F_2$ | | |
|---|---|---|---|---|---|---|
| LIGHT | EXTERNAL LIGHT | INTERNAL LIGHT | | EXTERNAL LIGHT | INTERNAL LIGHT | |
| | NO | ONLY R | | NO | NO | |
| DISPLAY CONTENT |  | | | | | |
| GRADATION VALUE (BEFORE CORRECTION) | 0 0 0<br>R G B | | | 0 0 0<br>R G B | 0 0 0<br>R G B | 0 0 0<br>R G B |
| GRADATION VALUE CORRECTION | NO | | | YES | YES | NO |
| INTERNAL LIGHT CORRECTION | R | G | B | R, G, B | | |
| | NO | 0→Lv | 0→Lv | 0→Lv | | |
| VISUALLY RECOGNIZED COLOR | j j j<br>R G B | | | j j j<br>R G B | 0.6j 0.6j 0.6j<br>R G B | 0 0 0<br>R G B |

DISPLAY DEVICE

CROSS-REFERENCE TO RELATED APPLICATIONS

This application claims priority from Japanese Application No. 2015-170697, filed on Aug. 31, 2015, the contents of which are incorporated by reference herein in its entirety.

BACKGROUND

1. Technical Field

The present invention relates to a display device.

2. Description of the Related Art

In a known display device (for example, Japanese Patent Application Laid-open Publication No. 2013-222515), a light source for display output includes a plurality of light emitting regions, and the intensity of light is adjustable for each light emitting region. This light adjustment function for each light emitting region is known as what is called a local dimming function.

When the local dimming function is used, outputs having identical luminance in terms of data appear differently depending on the intensity of light from each light emitting region in some cases. Thus, when a difference in the intensity of light between adjacent light emitting regions is equal to or larger than a predetermined value, such a phenomenon occurs that outputs having an identical luminance in terms of data from the adjacent display regions performing display output using light from these light emitting regions are visually recognized as different outputs in some cases. Such a phenomenon is further easily visually recognizable when an identical color is expected to be displayed continuously in a larger area, such as a background color.

For the foregoing reasons, there is a need for a display device that can decrease visual recognition of a difference in output luminance due to a difference in the intensity of light between adjacent light emitting regions.

SUMMARY

According to an aspect, a display device that is a reflective display device includes: a display unit including a plurality of pixels; an illumination unit that irradiates the display unit with light; a measurement unit that measures intensity of external light as part of light incident on the display unit, the external light being light other than internal light emitted from the illumination unit; and a control unit that controls intensity of the internal light and respective gradation values of the pixels based on the intensity of the external light measured by the measurement unit. The display unit includes a plurality of partial regions each including a plurality of pixels. The illumination unit includes a plurality of light emitting regions, the light emitting regions being provided to irradiate the partial regions with light, respectively. The control unit determines the intensity of the internal light for each of the light emitting regions. When pixels that are expected to perform display output at identical luminance are adjacent to each other in adjacent partial regions, and when a difference in the intensity of the internal light between light emitting regions corresponding to the adjacent partial regions is equal to or larger than a predetermined threshold, the control unit performs correction to increase luminance of a predetermined number of pixels belonging to a first partial region corresponding to a first light emitting region the intensity of the internal light from which is lower among the adjacent partial regions. The predetermined number of pixels are located closer to a second partial region corresponding to a second light emitting region the intensity of the internal light from which is higher among the adjacent partial regions.

BRIEF DESCRIPTION OF THE DRAWINGS

FIG. 13 is a schematic diagram illustrating exemplary setting of a white point;

FIG. 14 is a schematic diagram illustrating exemplary correction using the white point and magnification of luminance is performed on an input signal;

FIG. 15 is a schematic diagram illustrating exemplary calculation of compensation required luminance;

FIG. 16 is a schematic diagram illustrating exemplary processing of derivation of the intensity of internal light for each unit of processing;

FIG. 17 is a schematic diagram illustrating an exemplary calculation for determination of an output signal;

FIG. 18 is a diagram illustrating an example of control of internal light and calculation of a gradation value for each unit of processing;

FIG. 23 is a schematic diagram of correction to decrease visual recognition of a color difference;

FIG. 24 is a schematic diagram illustrating an exemplary degree of correction on a predetermined number of unit pixels;

FIG. 25 is a schematic diagram illustrating an exemplary degree of correction on the predetermined number of unit pixels;

FIG. 36 is a schematic diagram of exemplary correction in the second embodiment;

FIG. 37 is a schematic diagram illustrating an example in which a light source of one color is turned on only in one of two adjacent light emitting regions;

DETAILED DESCRIPTION

Figure 1:
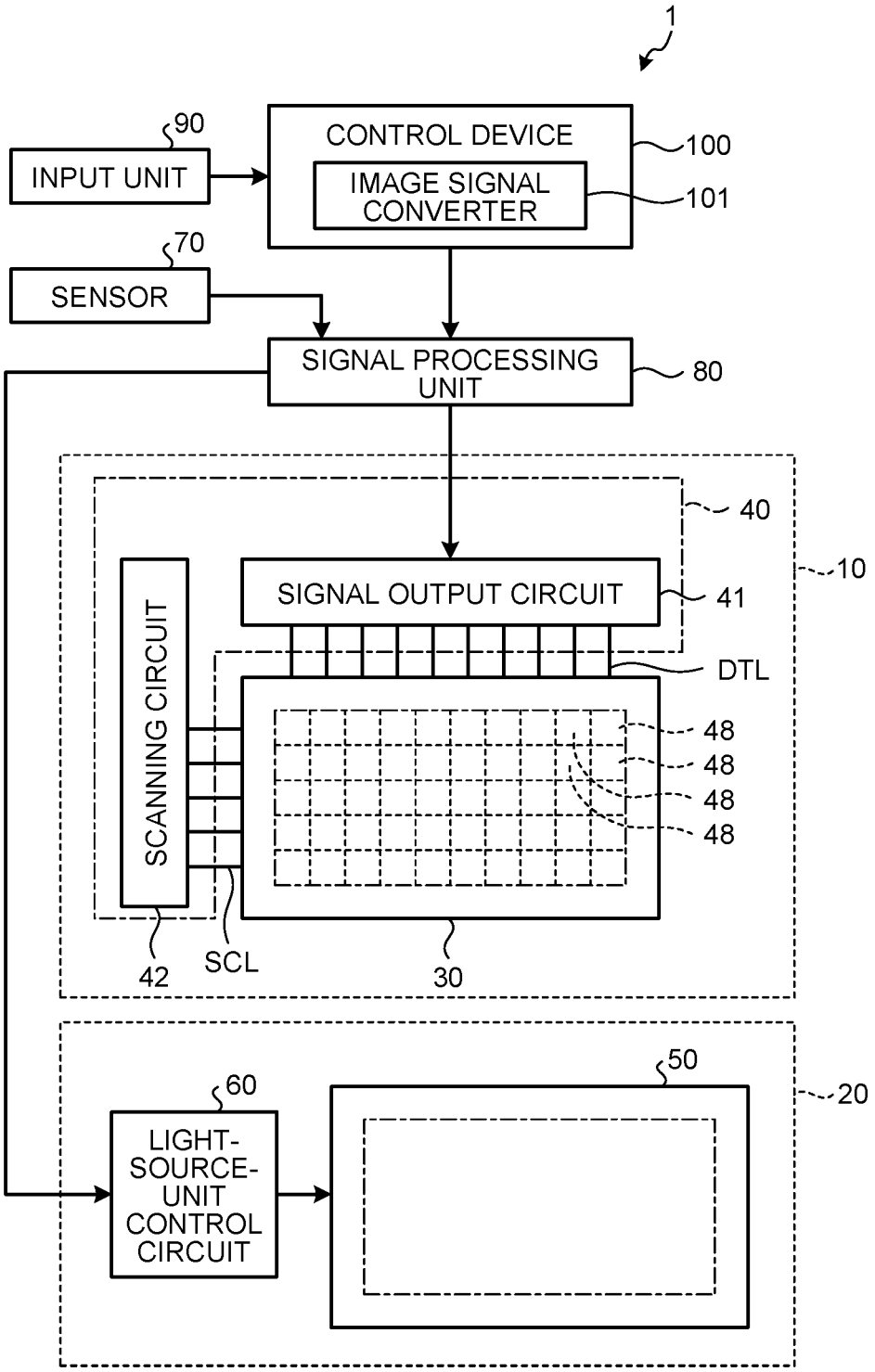
FIG. 1 is a block diagram of an exemplary main configuration of an electronic apparatus including a display device according to a first embodiment.

Embodiments of the present disclosure will be described below with reference to the accompanying drawings. The present disclosure is merely exemplary, and the scope of the present invention should include appropriate modifications easily thought of by the skilled person in the art without departing from the gist of the invention. For clearer description, the width, thickness, shape, and the like of each component are schematically illustrated in the drawings instead of the actual aspects in some cases. These are, however, merely exemplary and not intended to limit the interpretation of the present invention. In the present specification and the drawings, the same element as that already described with reference to a drawing already explained will be denoted by an identical reference sign, and detailed description thereof will be omitted as appropriate.

In this disclosure, when an element is described as being "on" another element, the element can be directly on the other element, or there can be one or more elements between the element and the other element.

First Embodiment

Figure 2:
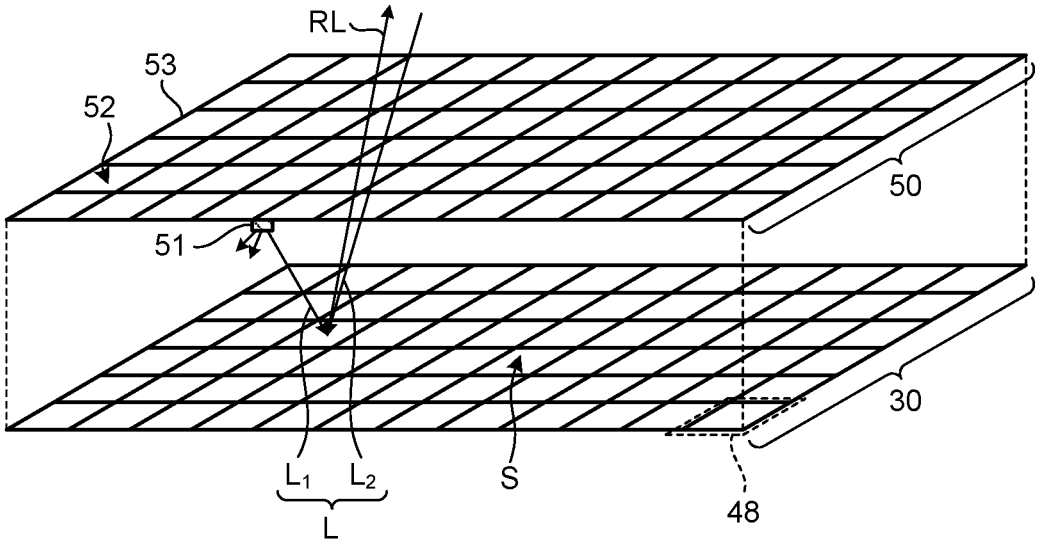
FIG. 2 is an exploded perspective view schematically illustrating a display device including an illumination apparatus according to the first embodiment.

FIG. 1 is a block diagram of an exemplary main configuration of an electronic apparatus 1 including a display device according to a first embodiment. FIG. 2 is an exploded perspective view schematically illustrating the display device according to the first embodiment. As illustrated in FIG. 1, a display device 1 includes a reflective display unit 10 including a plurality of pixels 48, an illumination unit 20 irradiating the display unit 10 with light, a sensor 70 measuring the intensity of external light, and a signal processing unit 80 serving as a control unit of the display device. The electronic apparatus 1 including the display device includes, in addition to the display device, an input unit 90 for performing various inputs to the electronic apparatus 1, and a control device 100 configured to perform various kinds of processing related to operation of the electronic apparatus 1.

The display unit 10 includes, for example, a display panel 30 and a display-panel drive circuit 40. The display panel 30 is a reflective display panel that performs video display using at least one of light (internal light $L_1$) emitted from the illumination unit 20 and light (external light $L_2$) other than the light from the illumination unit 20. The display panel 30 includes the pixels 48 arranged in a two dimensional matrix, and a reflective display element provided in each pixel 48. The reflective display element may include an electrophoretic element, a liquid crystal element such as a liquid crystal on silicon (LCOS), a micro electro mechanical systems (MEMS) element, an electrowetting element, or an electrochromic element, for example.

Figure 3:
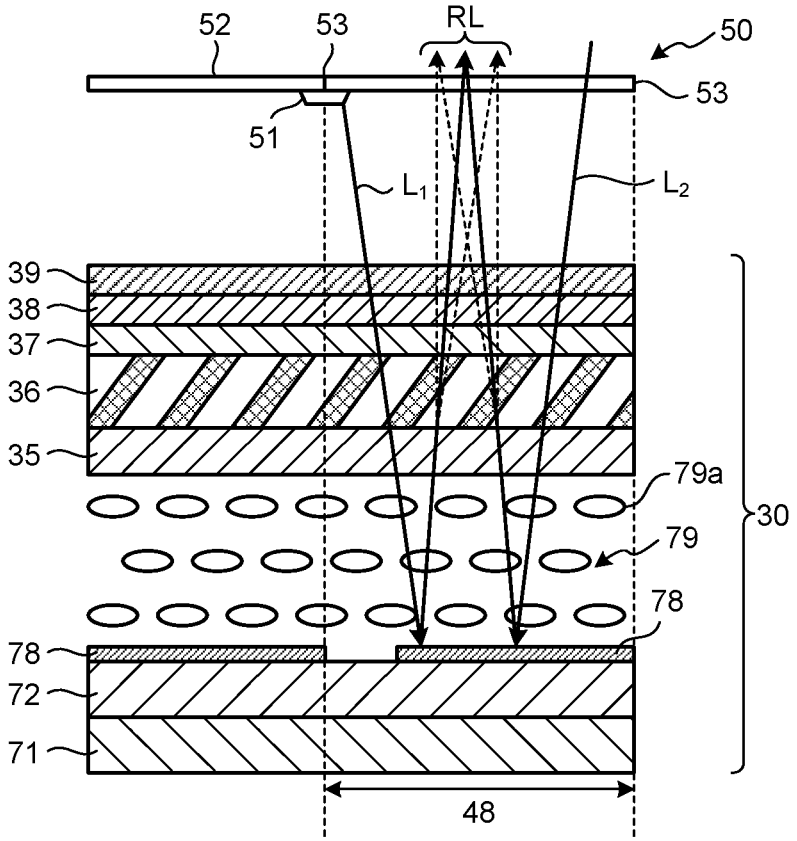
FIG. 3 is a diagram illustrating an exemplary cross-sectional structure of a display panel and a light source unit.

FIG. 3 is a diagram illustrating an exemplary cross-sectional structure of the display panel 30 and a light source unit 50. FIG. 3 illustrates an exemplary cross-sectional structure of the display panel 30 in which the reflective display element is a liquid crystal element including a liquid crystal material layer 79. For example, a flattening film 72 made of high-polymer material such as acrylic resin is formed on a back substrate 71 made of glass material, and a reflective electrode 78 made of metal material such as aluminum is formed on the flattening film 72. The reflective electrode 78 has a mirror-finished surface and is provided for each pixel 48. An element such as a TFT is coupled with each pixel 48 so as to control electric coupling between a signal line and the reflective electrode 78. In FIG. 3, various kinds of wiring such as the TFT and the signal line are omitted.

For example, a common electrode made of transparent conductive material such as ITO is provided to a front substrate 35 made of glass material. In a case of color display, each pixel 48 includes a set of sub-pixels, and, for example, a color filter is provided for each sub-pixel. The common electrode and other components are omitted in FIG. 3. The liquid crystal material layer 79 is arranged between the front substrate 35 and the back substrate 71. In FIG. 3, reference sign 79*a* denotes a schematically illustrated liquid crystal molecule included in the liquid crystal material layer 79.

The reflective electrode 78 acts as a reflection unit that reflects incoming light L (refer to FIG. 2) including the internal light $L_1$ and the external light $L_2$ to generate reflected light RL. The intensity of the reflected light RL with respect to the intensity of the incoming light L depends on the degree of modulation through the liquid crystal material layer 79. In other words, the transmissivity of light passing through the liquid crystal material layer 79 is changed by controlling the orientation of a liquid crystal in the liquid crystal material layer 79, thereby controlling the luminance of the pixel 48.

The front substrate 35 may have a configuration for adjusting the traveling direction of light and the degree of scattering in accordance with conditions such as the optical property of the liquid crystal material layer 79 and a view angle property required for the display panel 30. For example, in the present embodiment, an anisotropic scatterer 36 is disposed on a surface of the front substrate 35, the surface being on the opposite side of the liquid crystal material layer 79 side. In addition, a quarter wavelength plate 37, a half wavelength plate 38, and a polarization plate 39 are stacked on the anisotropic scatterer 36. In the present embodiment, the liquid crystal material layer 79 has such a thickness that the liquid crystal material layer 79 acts as a half wavelength plate when light makes a round trip therethrough by, for example, a spacer not illustrated, under a certain condition. The incoming light L is linearly polarized in a predetermined direction by the polarization plate 39, and then its polarization plane is rotated by 90° by the half wavelength plate 38, and thereafter circularly polarized by the quarter wavelength plate 37. The circularly polarized light transmits through the liquid crystal material layer 79 and is reflected by the reflective electrode 78, and then transmits through the liquid crystal material layer 79 and is scattered by the anisotropic scatterer 36.

Thereafter, the light transmits through the quarter wavelength plate 37 and the half wavelength plate 38 and reaches the polarization plate 39. The amount of the reflected light RL transmitting through the polarization plate 39 can be controlled by controlling voltage applied to, for example, a pixel electrode so as to control the alignment state of a liquid crystal molecule 17A in the liquid crystal material layer 79. In FIG. 3, a dashed line represents the reflected light RL thus scattered.

The display panel 30 is not limited to a particular configuration, but may be a publicly known device such as a reflective liquid crystal display panel or an electronic paper (for example, an electrophoretic type). The display panel 30 may be a monochrome display, or a color display using, for example, color filters of a plurality of colors. The display panel 30 includes a front panel including a transparent common electrode, a rear panel including a pixel electrode, and a liquid crystal material arranged between the front and rear panels, for example. The display panel 30 may have a pixel electrode made of material that reflects light, or may have a configuration in which a combination of a reflective film and a translucent pixel electrode to reflect light is used, the reflective film reflecting light and being made of, for example, metal. In the present embodiment, an ECB mode, which is one of vertical electric field modes, is employed as a liquid crystal drive mode, but other vertical electric field modes such as a TN mode and a VA mode may be employed. Alternatively, the display panel 30 may be driven in a horizontal electric field mode such as an IPS mode or an FFS mode. The display panel 30 may be configured as, for example, a liquid crystal display panel including a reflective display region and a transmissive display region in each pixel 48.

Figure 4:
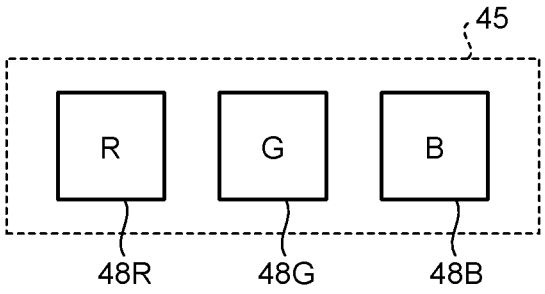
FIG. 4 is a diagram illustrating an exemplary unit of color reproduction performed by a plurality of pixels serving as sub-pixels.

FIG. 4 is a diagram illustrating an exemplary unit of color reproduction performed by the pixels 48 serving as sub-pixels. In the first embodiment, each pixel 48 is a sub-pixel that outputs one of a plurality of colors, and the display unit 10 performs color reproduction performed by a combination of outputs from a plurality of sub-pixels. Specifically, the pixel 48 is a sub-pixel that outputs one of red (R), green (G), and blue (B), and the display unit 10 performs color reproduction in accordance with an RGB signal by combining outputs from a sub-pixel 48R of red (R), a sub-pixel 48G of green (G), and a sub-pixel 48B of blue (B). Hereinafter, a combination of a plurality of sub-pixels for performing color reproduction in accordance with an RGB signal is referred to as a unit pixel 45 in some cases. The first embodiment describes a case in which one unit pixel 45 includes one sub-pixel 48R of red (R), one sub-pixel 48G of green (G), and one sub-pixel 48B of blue (B), but this is an exemplary configuration of the unit pixel 45. The configuration of the unit pixel 45 is not limited thereto, but may be changed as appropriate. In FIG. 1 and other figures, each pixel 48 has a square shape, but this is a schematic illustration and does not illustrate the shape of an actual pixel 48. The pixel 48 may be shaped in a polygon such as a rectangle or a quadrangle. The pixel 48 may refer to a sub-pixel of any color when there is no need to distinguish the colors of sub-pixels in a description. The pixels 48 illustrated in FIGS. 1 and 2 are each any one of the sub-pixel 48R of red (R), the sub-pixel 48G of green (G), and the sub-pixel 48B of blue (B), for example.

The display unit 10 includes the pixels 48 provided in a matrix in two directions (for example, an X direction and a Y direction orthogonal to each other) intersecting with each other along a plane, for example. In the first embodiment, a plurality of sub-pixels constituting one unit pixel 45 are arranged in the X direction, but this is an exemplary arrangement of sub-pixels. The arrangement of sub-pixels may be changed as appropriate. The display panel 30 in the first embodiment includes a matrix of a plurality of unit pixels 45.

The shape of the display panel 30 is not limited, and may be, for example, a horizontally long rectangular shape or a vertically long rectangular shape. When (M, N) represents the number M×N of the unit pixels 45 of the display unit 10, and Q represents the number of sub-pixels, exemplary values of (M, N) for the display panel 30 having a horizontally long rectangle shape include image display resolutions such as (640×Q, 480), (800×Q, 600), and (1024×Q, 768). Exemplary values of (M, N) for the display panel 30 having a vertically long rectangle shape include the resolutions obtained by interchanging the above values with each other.

The display panel 30 may have flexibility in at least part of its configuration. In this case, the display unit 10 includes, for example, a reflective display element including a plastic substrate and an electrophoretic element, and a drive element including an organic thin film transistor (TFT).

The display-panel drive circuit 40 includes a signal output circuit 41 and a scanning circuit 42. The display-panel drive circuit 40 stores an image signal in the signal output circuit 41 and sequentially outputs the image signal to the display panel 30. The signal output circuit 41 is electrically coupled with the display panel 30 through wiring DTL. The scanning circuit 42 is electrically coupled with the display panel 30 through wiring SCL. The signal output circuit 41 outputs, as appropriate, an output signal from the signal processing unit 80 in synchronization with the scanning circuit 42 that controls turning on and off of a switching element (for example, a TFT) for controlling an operation (light transmissivity) in accordance with the gradation value of a sub-pixel in the display panel 30. The scanning circuit 42 turns on the switching element of a pixel 48 coupled with a piece of the wiring SCL corresponding to the position of the pixel 48 indicated by the output signal from the signal processing unit 80.

The illumination unit 20 may include the light source unit 50 and a light-source-unit control circuit 60. The light source unit 50 is arranged facing a display surface S of the display panel 30, and configured to irradiate this display surface and transmit the reflected light from the display surface. In other words, the light source unit 50 is what is called a front light that irradiates the display surface S of the display panel 30 with the internal light $L_1$. The light source unit 50 includes a light emitting unit 51 including a self light emitting element provided on a translucent substrate. The translucent substrate may be made of, for example, glass or any of various plastic materials (for example, PMMA, polycarbonate resin, acrylic resin, amorphous polypropylene resin, and styrene resin including AS resin), and is transparent to transmit external light. The light emitting unit 51 may include an organic electroluminescence (EL) element, an inorganic EL element, an organic light emitting diode (OLED), or a micro light emitting diode (MicroLED). The light emitting unit 51 irradiates the display surface S of the display panel 30 with the internal light $L_1$, for example.

The light source unit 50 includes an opening 52 and a light-shielding part 53. The opening is formed for a region of each pixel 48 (pixel region) of the display panel 30, and the light-shielding part 53 is arranged in a lattice and provided in a region between the pixels 48 (inter-pixel region) in the display panel 30. The light-shielding part 53 serves as a black matrix (BM), and is made of, for example, predetermined black resin material. As illustrated in FIG. 2, the internal light $L_1$ enters the liquid crystal material layer 79 as part of the incoming light L or the entire incoming light L, and then is reflected by the reflective electrode 78 and emitted as the reflected light RL. Specifically, as illustrated in FIG. 3, the external light $L_2$ and the internal light $L_1$ passing through the opening 52 are emitted as the reflected light RL. The intensity of the reflected light RL varies depending on the optical transmissivity of the liquid crystal material layer 79 that is determined under control of the signal processing unit 80. The light-shielding part 53 is illustrated with solid lines in FIG. 2, and a space in each rectangle illustrated with solid lines serves as the opening 52. The position of one opening 52 in the X and Y directions corresponds to the position of one pixel 48 in the X and Y directions.

Figure 5:
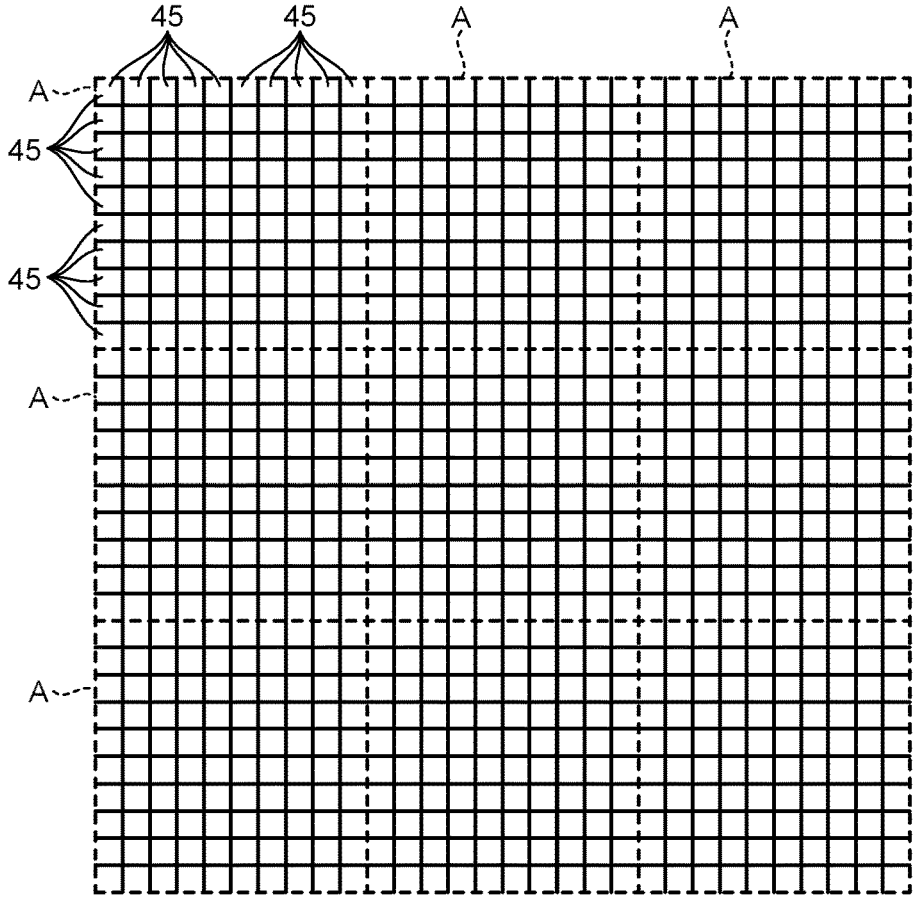
FIG. 5 is a diagram illustrating an exemplary relation between a partial region and a unit pixel.

FIG. 5 is a diagram illustrating an exemplary relation between a partial region and the unit pixel 45. In the first embodiment, the display unit 10 includes a plurality of partial regions each including a plurality of pixels 48, and the illumination unit 20 includes a plurality of light emitting regions that irradiate the respective partial regions with light. Each light emitting region can individually control the intensity of the internal light $L_1$. Specifically, the display panel 30 in the first embodiment includes the partial regions each as a unit of control of an output signal under control of the signal processing unit 80. Each partial region includes a plurality of (for example, X×Y=10×10) the unit pixels 45. In FIG. 5, one rectangle illustrated with solid lines represents one unit pixel 45, and one rectangle illustrated with dashed lines represents one partial region. In other words, the region of one unit pixel 45 illustrated in FIG. 5 includes the three pixels 48 illustrated in FIG. 4. Therefore, three openings 52 corresponding to the positions of these three pixels 48 in the X and Y directions and the light-shielding parts 53 surrounding the three openings 52 are located at these XY positions in the light source unit 50, respectively. Each light emitting region of the light source unit 50 includes at least one light emitting unit 51, and the illumination unit 20 can individually irradiate each partial region included in the display panel 30 with light emitted from the corresponding light emitting region. Hereinafter, a combination of one of the partial regions and a light emitting region that irradiates the one partial region with light may be referred to as one unit of processing.

The light-source-unit control circuit 60 controls, for example, the light quantity of light output from the light source unit 50. Specifically, the light-source-unit control circuit 60 controls the intensity of light (the internal light $L_1$) incident on each partial region by adjusting a duty ratio or voltage supplied to the light emitting unit 51 in each light emitting region included in the light source unit 50 based on a light emitting region control signal output from the signal processing unit 80.

The sensor 70 measures the intensity of light (the external light $L_2$) among light incident on the display unit 10, which is not emitted from the illumination unit 20. Specifically, the sensor 70 includes a component (for example, a photodiode) that generates an output in accordance with the measured intensity of light, a circuit that converts the output into a numerical value and data and outputs the value and data, and the like. The sensor 70 may further include a configuration such as a filter for dispersion and disperse the external light $L_2$ into light in colors corresponding to part or all of the colors of the pixels 48 of the display unit 10 so as to measure the intensity of light in each color. The sensor 70 in the first embodiment individually measures the intensity of light of each spectrum of red (R), green (G), or blue (B). A plurality of the sensors 70 are provided, for example, at positions relatively close to a display region of the display panel 30 in a region (frame region) outside the display region. More specifically, one or a plurality of sensors 70 are provided along the periphery and/or corners of the display region. When a plurality of the sensors 70 are provided, a measured value indicating the brightest measurement result, an average value or median value of a plurality of measurement results, or any of other numerical values can be employed as a measurement result of the sensors 70.

The signal processing unit 80 performs various kinds of processing related to the operation of the display device. Specifically, the signal processing unit 80 includes an integrated circuit such as a field-programmable gate array (FPGA), for example. This integrated circuit serves as, for example, a calculation unit that performs various kinds of arithmetic processing related to display output, and a storage unit that stores therein various kinds of data related to calculation performed by the calculation unit. The signal processing unit 80 calculates an output signal for each pixel and an output signal to be supplied to the illumination unit 20 for adjusting the brightness or the like of each light emitting unit, based on the brightness of a screen set through the input unit 90 and the intensity of the external light $L_2$ measured by the sensor 70, for example.

The input unit 90 may include a touch panel sensor provided integrally with the display unit 10, or a switch or the like provided to the electronic apparatus 1. A user can perform various kinds of inputs related to the operation of the electronic apparatus 1 through an operation on the input unit 90. Specifically, the user can perform setting related to the brightness of the screen in image display performed by the display unit 10 through an operation on the input unit 90, for example.

The control device 100 may include an integrated circuit such as an FPGA. This integrated circuit serves as a calculation unit that performs various kinds of arithmetic processing related to display output, and a storage unit that stores therein various kinds of data related to calculation performed by the calculation unit. The control device 100 serves as an image signal converter 101 that converts, for example, a plurality of pixel values (gradation values) included in data of an image to be displayed by the display device into an input signal to be input to the display device. The input signal is, for example, an RGB signal and includes information indicating the gradation values of the sub-pixel 48R of red (R), the sub-pixel 48G of green (G), and the sub-pixel 48B of blue (B) for each unit pixel 45. The image signal converter 101 outputs the input signal to the signal processing unit 80.

Figure 6:
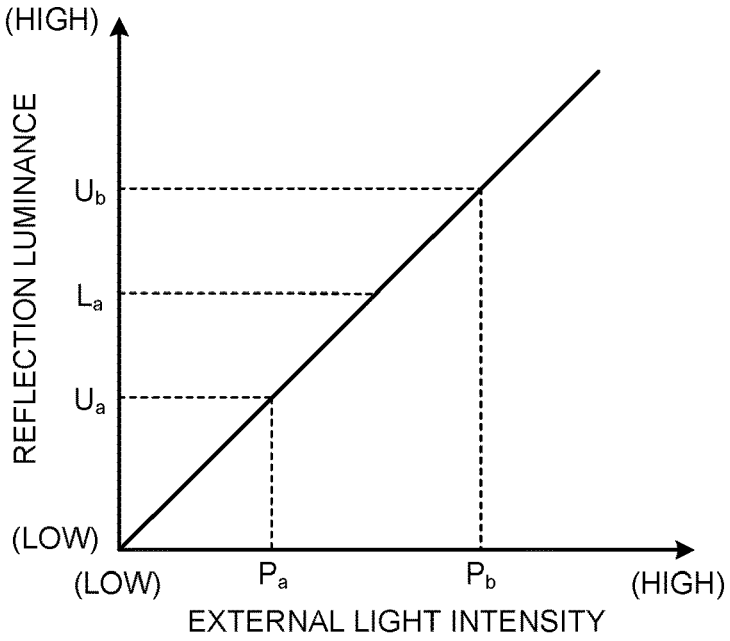
FIG. 6 is a schematic diagram illustrating a relation between the intensity of external light and reflection luminance of a unit pixel when the highest gradation value is output.
Figure 7:
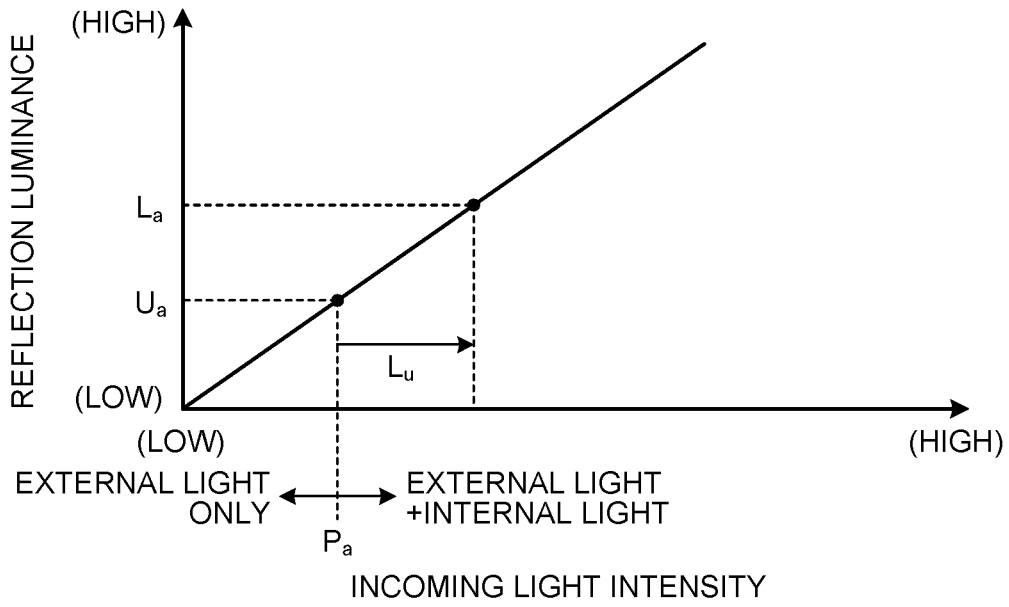
FIG. 7 is a diagram illustrating exemplary adjustment of internal light performed when the intensity of external light necessary for obtaining predetermined reflection luminance is not obtained.
Figure 8:
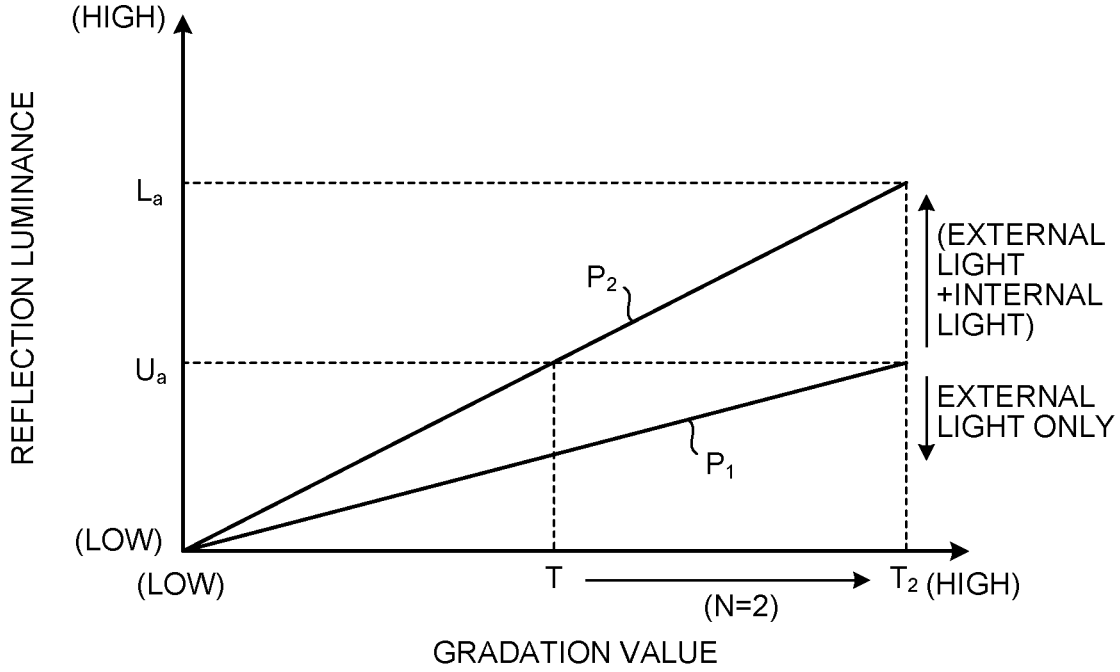
FIG. 8 is a diagram illustrating exemplary adjustment of internal light performed when the intensity of external light necessary for obtaining the predetermined reflection luminance is not obtained.
Figure 9:
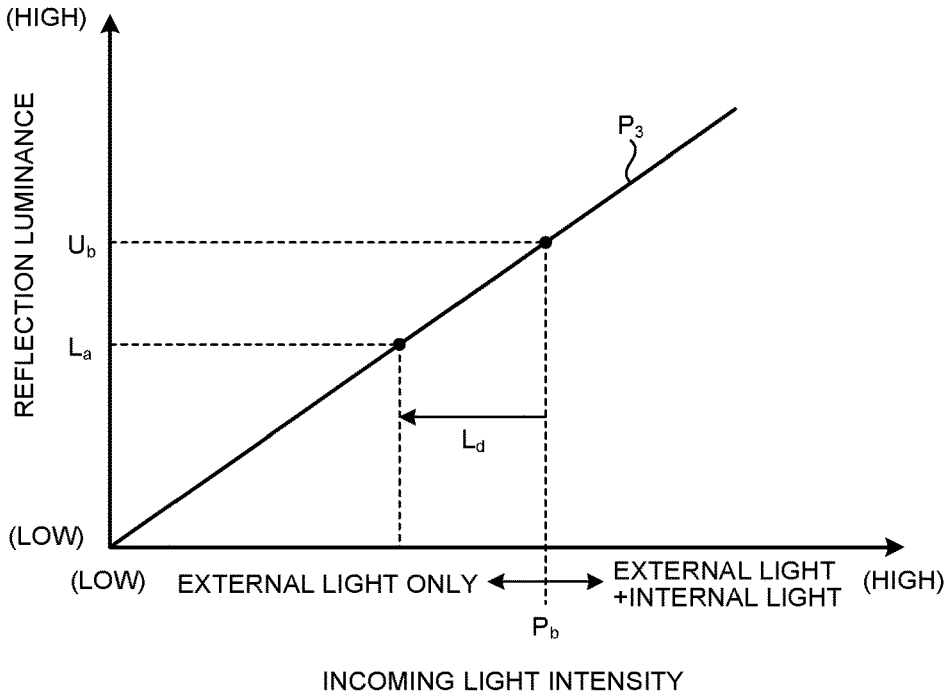
FIG. 9 is a diagram illustrating exemplary correction of a pixel gradation value performed when the intensity of external light is too high for the predetermined reflection luminance.
Figure 10:
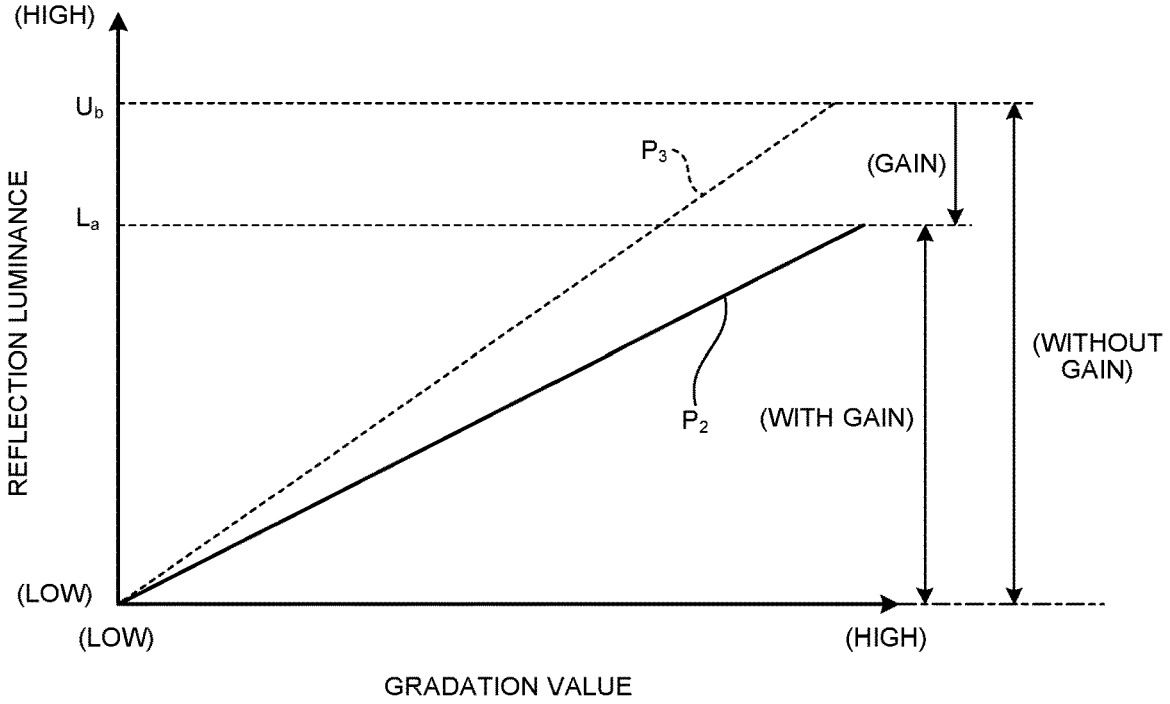
FIG. 10 is a diagram illustrating exemplary correction of a pixel gradation value performed when the intensity of external light is too high for the predetermined reflection luminance.

The following describes more detail of the display device in the present embodiment. First, a simplified description is made on a relation between predetermined reflection luminance, and the external light $L_2$ and the internal light $L_1$. FIG. 6 is a schematic diagram illustrating a relation between the intensity of external light and the reflection luminance of the unit pixel 45 when the highest gradation value is output. In the present embodiment, when the unit pixel 45 outputs the highest gradation value, in other words, when the unit pixel 45 performs output corresponding to an input signal of (R, G, B)=(255, 255, 255), the unit pixel 45 is in a "white display state" in which white having the highest luminance is output. This "white display" means display of an output of (R, G, B)=(255, 255, 255) without correction, and is not affected by a color ratio defined by a white point described later. In FIG. 6, line P illustrates a relation between the intensity of external light and the reflection luminance of the pixels 48 in the white display state. The values $U_a$ and $U_b$ indicate reflection luminance at the intensities $P_a$ and $P_b$ of external light as two particular patterns, respectively. The intensities $P_a$ and $P_b$ of external light have the relation of $P_a < P_b$, and the reflection luminance $U_a$ and the reflection luminance $U_b$ have the relation of $U_a < L_a < U_b$. FIGS. 7 and 8 are each a diagram illustrating an exemplary control performed when the intensity of external light necessary for obtaining predetermined reflection luminance is not obtained. FIGS. 9 and 10 are each a diagram illustrating an exemplary control performed when the intensity of external light is too high for the predetermined reflection luminance. The predetermined reflection luminance may be, for example, reflection luminance corresponding to the brightness of the screen set by a user using the electronic apparatus 1, or statistically-derived reflection luminance that allows a user looking at the electronic apparatus 1 to find the screen easy to visually recognize. The following description with reference to FIGS. 7 to 10 will be made on an assumption that reflection luminance $L_a$ is desired to be obtained in the white display state.

For example, at the reflection luminance $U_a$ provided only by the external light $L_2$ as illustrated in FIG. 7, the display unit 10 is unable to have the predetermined reflection luminance $L_a$ in some cases. In such a case, the signal processing unit 80 performs, using the light emitting unit 51, signal processing to irradiate the display region with light having an intensity corresponding to required luminance $L_U$ (luminance deficiency $L_u$). This signal processing enables irradiation of the reflective electrode with light having a necessary intensity for reflection luminance.

In the example illustrated in FIG. 8, according to a gradation property $P_1$ of the unit pixel 45 obtained only with the external light $L_2$, the reflection luminance $U_a$ is obtained in the white display state. In other words, to obtain reflection luminance (for example, the reflection luminance $L_a$) exceeding the reflection luminance $U_a$, the intensity of the incoming light L needs to be increased by irradiating the display panel 30 with the internal light $L_1$ in addition to the external light $L_2$. Thus, when a gradation value that requires reflection luminance exceeding the reflection luminance $U_a$ is output under a condition of the external light $L_2$ as illustrated in FIG. 8, the light emitting unit 51 is turned on. When the light emitting unit 51 is turned on to emit light having an intensity corresponding to the luminance deficiency $L_u$ illustrated in FIG. 7, the unit pixel 45 obtains a gradation property $P_2$ having larger reflection luminance at a gradation value than that of the gradation property $P_1$ and capable of obtaining the reflection luminance $L_a$ in the white display state.

In the example illustrated in FIG. 8, a reference sign T denotes a gradation value for outputting the reflection luminance $U_a$ with the gradation property $P_2$. The reflection luminance $U_a$ can be output with the incoming light L obtained from only the external light $L_2$ by setting the gradation value to the value in the white display state without turning on the light emitting unit 51. The reflection luminance $U_a$ may be obtained by outputting the gradation value T while the unit pixel 45 is in a state indicating the gradation property $P_2$ by turning on the light emitting unit 51. In order to obtain the reflection luminance $U_a$, one of the following operations are performed: control on the gradation value, turning-on of the light emitting unit 51, and control on the gradation value on the assumption that both the gradation value control and the turning-on are performed. Which operation is to be performed is determined based on reflection luminance $U_1$ required for output from another unit pixel 45 that shares the light-emitting unit 51. For example, when the unit pixel 45 that requires the reflection luminance $U_a$ for perform output and the unit pixel 45 that requires the reflection luminance $L_a$ for perform output are under the influence of the same light emitting unit 51, the light emitting unit 51 is turned on for the unit pixel 45 in need of the reflection luminance $L_a$, and thus the unit pixel 45 in need of the reflection luminance $U_a$ is controlled to output the gradation value T. In contrast, when only the unit pixels 45 that require reflection luminance equal to or lower than the reflection luminance $U_a$ are under the influence of the same light emitting unit 51, each unit pixel 45 can obtain the reflection luminance required for output by individually controlling the gradation value of the unit pixel 45 without turning on the light emitting unit 51.

As illustrated in FIG. 9, when the intensity of external light is too high for the predetermined reflection luminance $L_a$ and thus reflection luminance $U_b$ is obtained without controlling the output (gradation value) of the pixels 48, the unit pixel 45 has a gradation property $P_3$. As illustrated in FIG. 10, when the reflection luminance $U_b$ is higher than the predetermined reflection luminance $L_a$, the gradation property $P_3$ deviates from the gradation property $P_2$ with which the predetermined reflection luminance $L_a$ is obtained. In such a case, the signal processing unit 80 can lower the reflectance of the display region by applying a gain on an output from the unit pixel 45 in accordance with an excess intensity $L_d$ of external light to reduce the output. Therefore, the signal processing unit 80 can obtain the predetermined reflection luminance $L_a$. "Lowering the reflectance" means to reduce the intensity of the reflected light RL by reducing the gradation value of the unit pixel 45 to reduce the optical transparency of the reflective display element (for example, the pixels 48 included in the unit pixel 45). Specifically, for example, as illustrated in FIG. 10, the signal processing unit 80 applies a gain to the output to lower the reflection luminance corresponding to the gradation value of the unit pixel 45 than that obtained with the gradation property $P_3$ without application of the gain. This obtains the gradation property $P_2$ for the predetermined reflection luminance $L_a$.

As described above, the signal processing unit 80 performs control on the operation of the light-emitting unit 51, control on the output (gradation value) of each pixel 48, or both of the control. Thus, the display panel 30 can display an image at the predetermined reflection luminance $L_a$.

Figure 11:
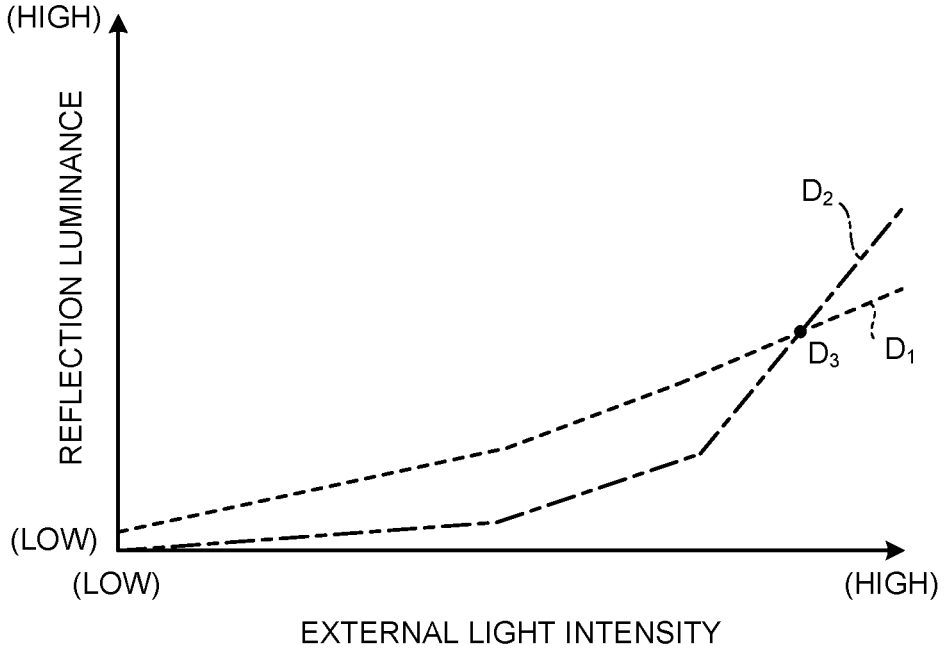
FIG. 11 is a graph illustrating an exemplary correspondence relation between the intensity of external light, the reflection luminance, and exemplary luminance.

FIG. 11 is a graph illustrating an exemplary correspondence relation between reflection luminance $D_1$ and exemplary luminance $D_2$ for the intensity of external light. Exemplary reflection luminance (referred to as exemplary luminance) that allows the user to find the screen easy to visually recognize varies depending on the intensity of external light as indicated by the exemplary luminance $D_2$ illustrated in FIG. 11, for example. This is because an output from the display unit 10 appears brighter in a darker environment. Thus, the signal processing unit 80 may control the exemplary luminance $D_2$ variably in accordance with the intensity of external light as illustrated in FIG. 11, even when the brightness of the screen is set by the user of the electronic apparatus 1 under a particular condition of the intensity of external light. The electronic apparatus 1 can perform display output at the brightness of the screen in accordance with the intensity of external light by setting the exemplary luminance $D_2$ as the "predetermined reflection luminance $L_a$". The signal processing unit 80 may perform control to maintain luminance set by the user irrespective of the intensity of external light.

The output from the display unit 10 is brighter with a higher intensity of external light. The exemplary luminance $D_2$ becomes equal to or higher than the reflection luminance $D_1$ when the intensity of external light exceeds a certain threshold (for example, the intensity of external light corresponding to an intersection $D_3$ of the reflection luminance $D_1$ and the exemplary luminance $D_2$ illustrated in FIG. 11). Under an environment in which the intensity of external light equal to or higher than the intensity of external light corresponding to the intersection $D_3$ is obtained, the signal processing unit 80 does not operate the light emitting unit 51. In contrast, under an environment in which the intensity of external light is lower than the intensity of external light corresponding to the intersection $D_3$, the signal processing unit 80 operates the light emitting unit 51.

In the first embodiment, the intensity of light is represented by a numerical value equal to or larger than 0. The intensity of light that provides reflection luminance corresponding to a gradation value indicated by an output signal for the pixels 48 of the display unit 10 is defined to be 1. Specifically, for example, the intensity of light at which a pixel 48 (for example, a sub-pixel) of a certain color controlled with a gradation value of 255 performs an output at luminance indicated by the gradation value of 255 is defined to be 1. In other words, when the intensity of light is 1, the maximum luminance obtained with the light is the upper limit of the number of bits (for example, 255 for 8 bits) of a gradation value indicated by an output signal.

Figure 12:
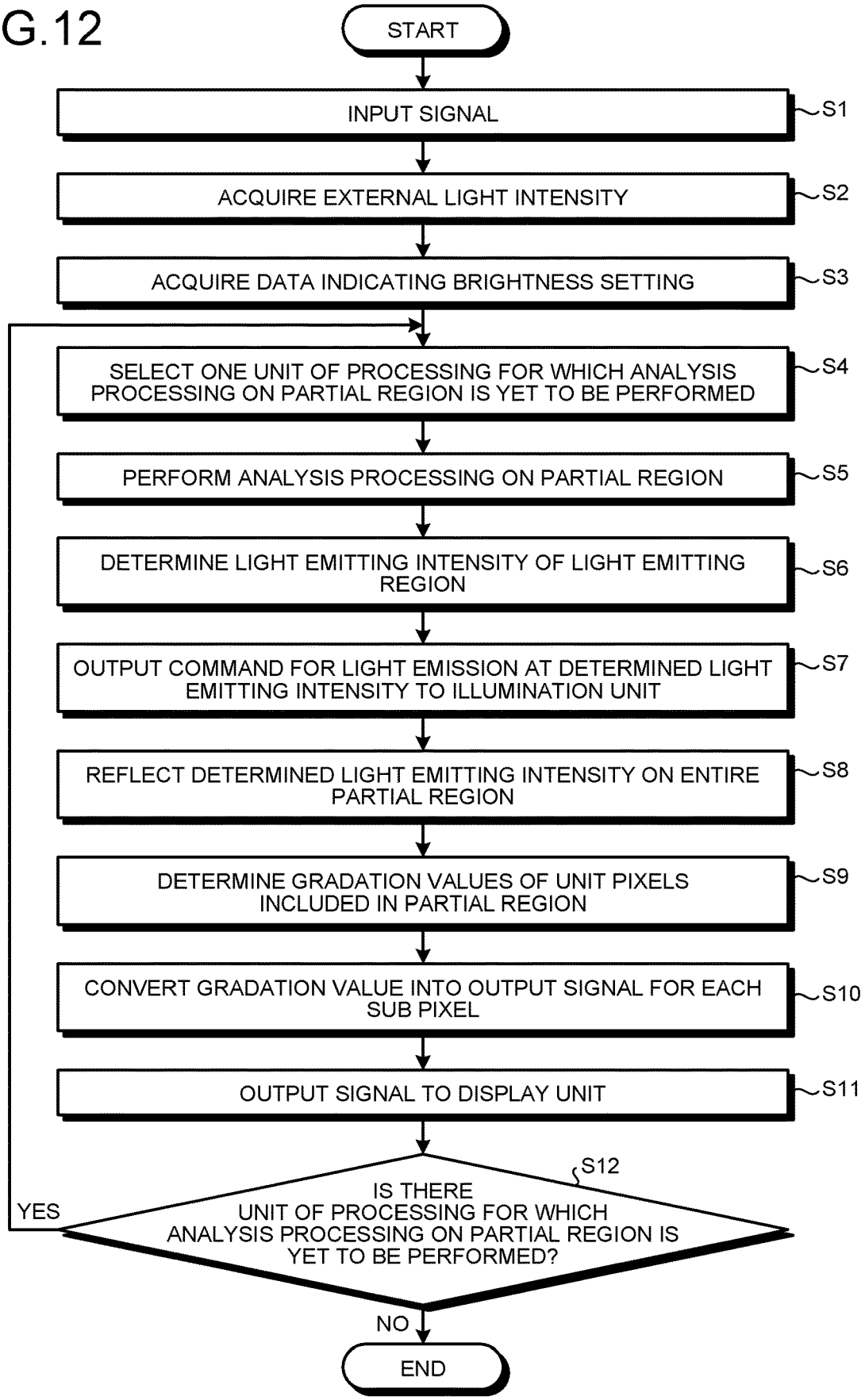
FIG. 12 is a flowchart illustrating an exemplary process of processing of display output for one frame performed by a signal processing unit.

FIG. 12 is a flowchart illustrating an exemplary process of processing of display output for one frame performed by the signal processing unit 80. When an input signal is input (step S1), the signal processing unit 80 acquires the intensity of external light measured by the sensor 70 (step S2). The signal processing unit 80 acquires data indicating setting of brightness (step S3). For example, when setting related to the brightness of the screen is performed by the user, the data indicating setting of the brightness is data reflecting the setting performed by the user. When the setting related to the brightness of the screen is not performed by the user, the data indicating setting of the brightness is data reflecting predetermined default setting. The default setting is, for example, setting for achieving statistically-derived reflection luminance that allows the user looking at the display unit 10 to find the screen easy to visually recognize, but this is merely exemplary default setting. The default setting is not limited thereto, and may be determined as appropriate. The processing at steps S1 to S3 may be processed in a different order or may be processed in parallel. Data indicating settings is stored in, for example, a storage unit included in the signal processing unit 80, but this is merely an exemplary specific method of storing settings. The method of storing settings is not limited thereto, and may be modified as appropriate. For example, the data indicating settings may be stored in a storage unit of the control device 100, or in a dedicated storage device provided to store the data indicating settings.

Following the processing at steps S1 to S3, the signal processing unit 80 selects one unit of processing for which analysis processing on a partial region is yet to be performed (step S4). The signal processing unit 80 performs the analysis processing on the partial region in the one unit of processing selected at step S4 (step S5). The analysis processing is based on settings of the gradation value and the brightness indicated by an input signal for each of unit pixels 45 belonging to one partial region, and in the present embodiment, is processing of identifying a pixel 48 at which the brightest output is performed in the partial region. The signal processing unit 80 determines the light emitting intensity of a light emitting region in the one unit of processing selected at step S4 based on the result of the processing at step S5 (step S6). The signal processing unit 80 outputs, to the illumination unit 20, a command (light emitting region control signal) for causing the light emitting region in the one partial region selected at step S4 to emit light at the light emitting intensity determined at step S6 (step S7). The brightness of the front light and the degree of extension at each pixel that are obtained through the processing at step S7 are reflected on a partial region including the pixel at which the brightest output is performed (step S8).

The signal processing unit 80 determines, based on the input signal received at step S1 and the result of the processing at step S6, the gradation value (for example, R, G, and B) of each unit pixel 45 belonging to the partial region in the one unit of processing selected at step S4 (step S9). The signal processing unit 80 converts the gradation value determined at step S9 into an output signal (for example, an output signal of R, G, or B) for each sub-pixel (step S10), and outputs the output signal to the display unit 10 (step S11). The processing at steps S7 and S9 to S11 may be processed in a different order or may be processed in parallel. The timings of the processing at step S7 and the processing at step S11 are desirably simultaneous, or desirably have a time difference therebetween that is short enough not to be felt by a user visually recognizing display output performed by the display device.

The signal processing unit 80 determines whether there is a unit of processing on which analysis processing of a partial region is yet to be performed (step S12). If it is determined that there is a unit of processing on which analysis processing of a partial region is yet to be performed (Yes at step S12), the signal processing unit 80 proceeds to step S4. If it is determined that there is no unit of processing on which analysis processing of a partial region is yet to be performed (No at step S12), the signal processing unit 80 ends the processing of display output for one frame.

The following description with reference to FIGS. 13 to 16 is sequentially made on setting of a white point in accordance with the result of measurement of the external light $L_2$ (up to step S2), determination of the intensity of the internal light $L_1$ for each unit of processing based on the intensity of the external light $L_2$ and a luminance magnification (N) (up to step S7), and adjustment of the gradation value of each pixel 48 in accordance with the intensity of the external light $L_2$ and the internal light $L_1$ (up to step S10). FIG. 13 is a schematic diagram illustrating exemplary setting of a white point. For example, as illustrated in FIG. 13, the definition of white using the gradation value of an RGB signal indicated by an input signal is (R, G, B)=(255, 255, 255). The ratio of the color components in the definition of white is red (R):green (G):blue (B)=1:1:1. In order to set the ratio of the color components constituting white in the output of the display device to red (R):green (G):blue (B)=1:0.8:0.8, the signal processing unit 80 performs correction by multiplying the gradation values of green (G) and blue (B) included in the RGB signal indicated by the input signal by 0.8. Accordingly, the gradation values of the RGB signal become (R, G, B)=(255, 204, 204), for example. In other words, the white point indicates the ratio of a plurality of colors constituting white to be reproduced with a combination of the colors. The signal processing unit 80 corrects the gradation value of each color so that white (for example, (R, G, B)=(255, 255, 255)) indicated by the input signal agrees with the ratio of the colors defined by the white point.

When the ratio of the color components of the external light $L_2$ is red (R):green (G):blue (B)=1:0.8:0.8, the display device can perform color reproduction in the same manner as color reproduction performed under illumination of only the external light $L_2$ even under illumination of light in which the ratio of the color components is red (R):green (G):blue (B)=1:1:1 (for example, only the internal light $L_1$) by correcting the input signal as described above with reference to FIG. 13. In this way, the display device can perform any color reproduction by correcting the input signal based on color reproduction of a predetermined color (for example, white). In the description with reference to FIG. 13, the ratio of the color components of the external light $L_2$ is exemplified. However, the definition of white is not limited to the ratio of the color components of the external light $L_2$, and may be freely predetermined. The definition of white in the RGB signal indicated by the input signal is not limited to (R, G, B)=(255, 255, 255), and may be changed as appropriate. The signal processing unit 80 corrects the input signal in accordance with a difference between the ratio of the color components of the input signal and the ratio (white point) of the color components constituting white as a target in the output from the display device. The signal processing unit 80 may correct the input signal using the white point with a color management mechanism (for example, the 3×3 matrix as represented by the expression (1)). The left side of the expression (1) represents the white point, the matrix (R, G, B) in the right side represents the gradation values of the input signal (RGB signal), and coefficients constituting the 3×3 matrix represent coefficients for correction. A color as a reference for correcting the gradation value may be any color other than white.

$$\begin{pmatrix} R' \\ G' \\ B' \end{pmatrix} = \begin{pmatrix} a11 & a12 & a13 \\ a21 & a22 & a23 \\ a31 & a32 & a33 \end{pmatrix} \begin{pmatrix} R \\ G \\ B \end{pmatrix} \tag{1}$$

In the first embodiment, a case is exemplified in which the RGB signal is represented as an 8-bit value. However, this is merely an example of the RGB signal, and the embodiment is not limited thereto. Specific matters such as the number of bits of the RGB signal can be changed as appropriate. For example, a value larger than the 8-bit value such as a 16-bit value may be used, or a value smaller than the 8-bit value such as a 4-bit value may be used.

The following describes the analysis processing at step S5 and correction of the brightness in an output. FIG. 14 is a schematic diagram illustrating an exemplary correction performed on the input signal using the white point and the luminance magnification. For example, when the luminance of a color reproduced by an RGB signal indicated by the input signal is to be multiplied by N (for example, N=2) in an output of the display device, the signal processing unit 80 calculates a required luminance value by multiplying the gradation value of the RGB signal indicated by the input signal by a correction value in accordance with the white point and a value (N) indicating the luminance magnification, as illustrated in FIG. 14. The required luminance value includes information indicating the ratio of colors (for example, red (R), green (G), and blue (B)) necessary for an output and information indicating the luminance of each color.

In the following description with reference to FIGS. 17 to 19, a case is exemplified in which the intensity of the external light is (R(OL), G(OL), B(OL))=(1, 0.8, 0.8), and the ratio of the color components indicated by the white point determined in accordance with the intensity of the external light is red (R):green (G):blue (B)=(255:204:204). That is, the white point is set for reproducing white that is visually recognized when the display output of (R, G, B)=(255, 255, 255) is performed under the environment with only the external light $L_2$. Such a setting of the white point is merely an example. The embodiment is not limited thereto, and can be changed as appropriate. For example, the white point may be set irrespective of the external light $L_2$.

In the first embodiment, the signal processing unit 80 determines N based on the external light intensity measured by the sensor 85. Specifically, the signal processing unit 80 defines N as a value corresponding to a ratio between the reflection luminance illustrated in FIG. 8 and optimum luminance, for example. As a specific example, when the sensor 85 measures the intensity of external light the reflection luminance of which is ½ of the exemplary luminance $D_1$, the signal processing unit 80 sets N to be 2. In this way, by setting N to be the reciprocal of reflection luminance/exemplary luminance $D_1$, the signal processing unit 80 can correct the input signal based on the intensity of external light. In the first embodiment, an upper limit value of N depends on the ratio between the intensity of external light and the intensity of the internal light $L_1$ and on an upper limit of the intensity of the internal light $L_1$. Alternatively, the value (N) indicating the luminance magnification does not necessarily depend on the intensity of external light, and may be set to be a predetermined real number larger than 0 (N>0).

For example, as illustrated in FIG. 17, it is assumed that the input signal indicates (R, G, B)=(180, 225, 80). In this case, when the intensity of external light is (R(OL), G(OL), B(OL))=(1, 0.8, 0.8) and when the ratio of the color components indicated by the white point determined based on the intensity of external light is red (R):green (G):blue (B)=(255:204:204), as indicated by "white point" illustrated in FIG. 17, the signal processing unit 80 multiplies the gradation value of red (R) by 1 and multiplies the gradation values of green (G) and blue (B) by 0.8 as correction values based on the white point. As indicated by "luminance magnification (N)" illustrated in FIG. 17, the signal processing unit 80 multiplies the gradation value of each color by a value corresponding to the luminance magnification (N) (for example, N=2). Thus, in the example illustrated in FIG. 17, (Rt, Gt, Bt)=(360, 360, 128) is calculated as the required luminance value.

FIG. 15 is a schematic diagram illustrating exemplary calculation of a compensation required luminance. Depending on the value (N) indicating the luminance magnification, the required luminance value may exceed the upper limit (for example, (R, G, B)=(255, 204, 204) indicated by the white point) of a gradation value that can be reproduced with the external light $L_2$ only, as illustrated in the example in FIG. 14. In this case, in order to perform output corresponding to the gradation value of the required luminance value that exceeds the upper limit, the signal processing unit 80 performs processing to obtain the internal light $L_1$ in accordance with the output of the gradation value exceeding the upper limit. Specifically, for example, as illustrated in FIG. 15, the maximum luminance of (255, 204, 204) of the color components that can be displayed with the external light $L_2$ is subtracted from the required luminance value, and luminance in accordance with the remaining luminance (compensation required luminance) of the color components is set as the color components of luminance to be compensated by the internal light $L_1$. More specifically, the signal processing unit 80 uses Expressions (2), (3), and (4) below to calculate an output from a light emitting region for compensating the luminance deficiency for each color component, in other words, the intensity of the internal light $L_1$ to be emitted from the light emitting unit 51 provided in the light emitting region. The intensity of the internal light $L_1$ takes, for example, a value equal to or larger than 0, where 0 indicates that the light emitting region is not turned on, and a predetermined maximum value (for example, 1) indicates that the light emitting region is turned on at the maximum output. When the intensity of the internal light $L_1$ necessary for compensating the luminance deficiency exceeds 0 for any color component, a light emitting region needs to be turned on. The signal processing unit 80 performs processing to turn on the light emitting unit 51 in accordance with the maximum intensity of the calculated intensities of the internal light $L_1$ for the color components. The maximum intensity (FLMAX) of the internal light $L_1$ is calculated by using, for example, Expression (5) below. The left-hand sides (R(FL), G(FL), and B(FL)) of Expressions (2), (3), and (4) represent the intensities of the internal light $L_1$ from the light emitting region needed for reproduction of the color components of red (R), green (G), and blue (B). Rf, Gf, and Bf in Expressions (2), (3), and (4) indicate the values of the compensation required luminance (refer to FIG. 15). FL(r), FL(g), and FL(b) in Expressions (2), (3), and (4) represent luminance values of red (R), green (G), and blue (B) compensated when the light emitting region is turned on at the maximum output. In the first embodiment, the color components of light (the internal light $L_1$) from the light emitting region have a ratio of red (R):green (G):blue (B)=1:1:1 and FL(r)=FL(g)=FL(b)=255, but this is an exemplary output property of the light emitting region, and the present invention is not limited thereto. FL(r), FL(g), and FL(b) are determined in accordance with the color components and the maximum output of the light output from the light emitting region.

$$R(FL)=Rf/FL(r) \tag{2}$$

$$G(FL)=Gf/FL(g) \tag{3}$$

$$B(FL)=Bf/FL(b) \tag{4}$$

$$FL\mathrm{MAX}=\mathrm{MAX}\{R(FL),G(FL),B(FL)\} \tag{5}$$

For example, when the required luminance values (refer to FIGS. 17 and 18) are (Rt, Gt, Bt)=(360, 360, 128), and when the maximum values of the reflection luminance generated by the external light $L_2$ are (R, G, B)=(255, 204, 204), the values of (R, G, B)=(105, 156, 0) are calculated (refer to FIG. 18). In this calculation, if a value obtained by subtracting the maximum value of the reflection luminance generated by the external light $L_2$ from the required luminance value becomes smaller than 0, it is determined that the value is 0. The gradation values of the colors obtained with the above values indicate the compensation required luminance (Rf, Gf, Bf).

Substituting, into Expressions (2) to (4), compensation required luminance illustrated in FIG. 18 and the luminance values of red (R), green (G), and blue (B) (FL(r)=FL(g)=FL(b)=255) to be compensated when the light emitting region is turned on at the maximum output in the present embodiment yields R(FL)=0.41, G(FL)=0.61, and B(FL)=0. In this case, 0.61 is the largest value. Thus, Expression (5) yields FLMAX=0.61 among R(FL), G(FL), and B(FL), G(FL). The signal processing unit 80 in the present embodiment rounds a fractional number obtained in the calculation to two decimal places, but any method may be applied to process a fractional number.

For example, a value (for example, N=2) in accordance with the luminance magnification (N) is applied to the gradation value T illustrated in FIG. 8 to calculate a gradation value $T_2$. The gradation value T can be output with the external light $L_2$ only. Thus, the gradation value T can be output with the external light $L_2$ only. However, the gradation value $T_2$ exceeds the gradation value T. Thus, compensation with the internal light $L_1$ in addition to the external light $L_2$ is needed for outputting the gradation value $T_2$. In this case, the compensation required luminance is calculated as a difference between an intensity necessary for outputting the gradation value $T_2$ and the intensity of external light (for example, a difference between the reflection luminance $U_a$ and the reflection luminance $L_a$).

In the first embodiment, the intensity of light (internal light $L_1$) emitted from the light-emitting region is controlled for each unit of processing. Thus, the intensity of the internal light $L_1$ required in each unit of processing needs to provide the luminance corresponding to the output from the unit pixel 45 that performs output with the maximum luminance out of the unit pixels 45 belonging to a partial region in the unit of processing. The signal processing unit 80 calculates the required luminance and the maximum intensity of the internal light $L_1$ using Expressions (2) to (5) for each of the unit pixels 45 belonging to one partial region. The signal processing unit 80 employs the maximum FLMAX of the FLMAXs calculated for the respective unit pixels 45 as the intensity (IL) of the internal light $L_1$ from the light emitting region in the unit of processing including the one partial region. The processing described above corresponds to the analysis processing. In other words, the analysis processing performed by the signal processing unit 80 is processing for calculating the required luminance value for the luminance value of a pixel 48 to be N times (N>0) as high as the luminance value indicated by the input signal, the pixel 48 performing output with the highest gradation value out of the pixels 48 included in a predetermined image display region (e.g., one partial region). To calculate the compensation required luminance in the analysis processing, the signal processing unit 80 determines the intensity of the internal light $L_1$ based on the result of comparison between the intensity of external light and the required luminance value (e.g., the result obtained by subtracting the upper limit of the gradation value reproducible only with the external light $L_2$ from the required luminance value). In this manner, the signal processing unit 80 determines the intensity of the internal light $L_1$ for each of a plurality of light emitting regions.

The intensity (IL) of the internal light $L_1$ is a value indicating the intensity of light (the internal light $L_1$) emitted from a light emitting region in one unit of processing. The analysis processing is processing of determining the intensity of the internal light $L_1$. The signal processing unit 80 treats the intensity of the internal light $L_1$ as the light emitting intensity of a light emitting region in one unit of processing. The signal processing unit 80 outputs, to the light-source-unit control circuit 60, a light emitting region control signal as a command to emit light from the light emitting region with the intensity of the internal light $L_1$.

FIG. 16 is a schematic diagram illustrating exemplary processing of derivation of the intensity of the internal light $L_1$ for each unit of processing. In FIG. 16, the gradation value having the maximum value is shaded for each color of each unit of processing. As illustrated in FIG. 16, the required luminance values (Rt, Gt, Bt) of unit pixels 45 included in a partial region of a unit $U_1$ of processing are (360, 360, 128), (300, 300, 100), (200, 200, 50), (100, 100, 25), (50, 50, 0), and so on. In the partial region of the unit $U_1$ of processing, the required luminance value (Rt, Gt, Bt)=(360, 360, 128) of one unit pixel 45 has the maximum value for all of the required luminance value (Rt) of red (R), the required luminance value (Gt) of green (G), and the required luminance value (Bt) of blue (B). Accordingly, the signal processing unit 80 employs FLMAX (0.61) as the intensity of the internal light $L_1$, the FLMAX being calculated based on the required luminance value (Rt, Gt, Bt)=(360, 360, 128) of the one unit pixel 45. In other words, the intensity of the internal light $L_1$ is determined based on a pixel 48 having a gradation value most in need for compensation with the internal light $L_1$ in one partial region. The intensity of the internal light $L_1$ is determined independently from a low gradation value of any other pixel 48 included in the one partial region.

The required luminance values (Rt, Gt, Bt) of unit pixels included in a partial region of a unit $U_2$ of processing are (360, 250, 100), (300, 360, 100), (100, 100, 128), (100, 100, 25), (50, 50, 0), and so on. In the partial region of the unit $U_2$ of processing, a unit pixel 45 having the required luminance value (360, 250, 100) has the maximum required luminance value (Rt=360) of red (R). A unit pixel 45 having the required luminance value (300, 360, 100) has the maximum required luminance value (Gt=360) of green (G). A unit pixel 45 having the required luminance value (100, 100, 128) has the maximum required luminance value (Bt=128) of blue (B). In this case, the signal processing unit 80 employs the maximum required luminance value of the required luminance values of the respective colors indicated by the required luminance values of the unit pixels 45 in calculation of the intensity of the internal light $L_1$. Accordingly, FLMAX of the unit pixel 45 having (Rt=360) is 0.41. FLMAX of the unit pixel 45 having (Gt=360) is 0.61. FLMAX of the unit pixel 45 having (Bt=128) is 0. Thus, the intensity of the internal light $L_1$ is 0.61 for the unit $U_2$ of processing. In this manner, the required luminance value for deriving the intensity of the internal light $L_1$ is determined for each unit of processing based on the required luminance values of unit pixels 45 included in one unit of processing. The signal processing unit 80 derives the intensity of the internal light $L_1$ for each unit of processing, and calculates the intensity of the internal light $L_1$ based on the derived intensity of internal light $L_1$ and the intensity of external light.

Although omitted in FIG. 16 and description, the signal processing unit 80 in the present embodiment individually calculates FLMAX for all unit pixels included in a unit of processing, and then specifies the maximum FLMAX for each unit of processing to set the specified maximum FLMAX as the intensity of the internal light $L_1$.

In the present embodiment, the maximum FLMAX is set as the intensity of the internal light $L_1$ for each unit of processing after FLMAX is calculated for each unit pixel 45. However, the signal processing unit 80 may specify the maximum gradation value of each color included in the unit pixel 45 for each unit of processing, calculate FLMAX for outputting the specified maximum gradation value of each color, and set the FLMAX as the intensity of the internal light $L_1$. In this case, the signal processing unit 80 calculates, for any of the unit $U_1$ of processing and the unit $U_2$ of processing, the intensity of the internal light $L_1$ (FLMAX=0.61) based on the compensation required luminance of (Rf, Gf, and Bf)=(105, 156, 0) calculated based on the required luminance value of (Rt, Gt, Bt)=(360, 360, 128).

FIG. 17 is a schematic diagram illustrating exemplary calculation for determination of an output signal. The signal processing unit 80 corrects the required luminance value on the assumption of an increase in the luminance due to light from the light emitting region turned on according to the maximum intensity of the internal light $L_1$. Specifically, the signal processing unit 80 corrects the required luminance value using Expressions (6) to (8) below, and determines a gradation value (O(R), O(G), O(B)) indicated by an output signal to each sub-pixel included in the unit pixel 45. Rt, Gt, and Bt in Expressions (6) to (8) represent the color components of red (R), green (G), and blue (B) indicated by the required luminance value. R(OL), G(OL), and B(OL) in Expressions (6) to (8) represent intensities achievable with the external light $L_2$. R(IL), G(IL), and B(IL) in Expressions (6) to (8) represent intensities achievable with light (the internal light $L_1$) from the light emitting region, in other words, the intensity of the internal light $L_1$. Specifically, R(IL), G(IL), and B(IL) are maximum FLMAX values in a unit of processing.

$$O(R)=Rt/(R(OL)+R(IL)) \quad (6)$$

$$O(G)=Gt/(G(OL)+G(IL)) \quad (7)$$

$$O(B)=Bt/(B(OL)+B(IL)) \quad (8)$$

As indicated by Expressions (6) to (8), the signal processing unit 80 of the display device calculates the output gradation value of each pixel 48 based on Expression (9) below, when OL represents the intensity of external light, IL represents the intensity of the internal light $L_1$, I represents a gradation value indicated by an input signal, and O represents an output gradation value of the pixel 48. When IL>0 is satisfied, the signal processing unit 80 in the first embodiment calculates the required luminance value under the condition that a gradation value for achieving the maximum light transmissivity is set to be the output gradation value of a pixel 48 that performs output at the highest gradation value among pixels 48 included in a predetermined image display region (for example, one partial region). Specifically, in the example illustrated in FIG. 17, green (G) is a color of light having the intensity employed as the intensity (IL) of the internal light $L_1$ from a light emitting region in a unit of processing, in other words, a color that is most in need for compensation of the intensity of light with the internal light $L_1$. Accordingly, the sub-pixel 48G of green (G) included in a unit pixel 45 that is most in need for compensation of the intensity of light with the internal light $L_1$ performs output at the maximum gradation value (255). Minimization of the compensation with the internal light $L_1$ and desired luminance can be both achieved by controlling the gradation value in this manner.

$$O=I\times N/(OL+IL) \quad (9)$$

Expressions (10) to (12) below are obtained by applying the example illustrated in FIG. 20 to Expressions (6) to (8). The following describes an example in which FLMAX=0.61 based on the compensation required luminance of (Rf, Gf, Bf)=(105, 156, 0) illustrated in FIG. 18 is set as the intensity (IL) of the internal light $L_1$. In other words, the intensity of the internal light $L_1$ can be expressed as (R(IL), G(IL), B(IL))=(0.61, 0.61, 0.61). When the intensity of external light is (R(OL), G(OL), B(OL))=(1, 0.8, 0.8), the internal light $L_1$ of (R(IL), G(IL), B(IL))=(0.61, 0.61, 0.61) is added to the intensity of external light for each color component. Thus, "(R(OL)+R(IL))" in Expression (6), in other words, the intensity of red light due to the incoming light L is "1.61" as indicated by Expression (10) below. "(G(OL)+G(IL))" in Expression (7), in other words, the intensity of green light due to the incoming light L is "1.41" as indicated by Expression (11) below. "(B(OL)+B(IL))" in Expression (8), in other words, the intensity of blue light due to the incoming light L is "1.41" as indicated by Expression (12) below. The signal processing unit 80 performs output gradation value control for outputting the required luminance value of (Rt, Gt, Bt)=(360, 360, 128) under illumination with the incoming light L with these intensities. Specifically, as indicated by Expressions (10) to (12) below, the signal processing unit 80 divides the required luminance value of each color by the intensity of light of the color component due to the incoming light L. As a result, as illustrated in FIG. 20, (O(R), O(G), O(B)) is (223, 255, 91).

$$O(R)=360/(1+0.61)=223 \quad (10)$$

$$O(G)=360/(0.8+0.61)=255 \quad (11)$$

$$O(B)=128/(0.8+0.61)=91 \quad (12)$$

"360" in Expression (10) is a value obtained by multiplying a gradation value (R=180) indicated by an input signal by N (N=2). Thus, when OL represents the intensity of external light (R(OL)=1), IL represents the intensity of the internal light $L_1$ (R(IL)=0.61), I represents the gradation value (R=180) indicated by the input signal, and O represents an output gradation value (O(R)=223) of a pixel, the signal processing unit 80 calculates the output gradation value based on Expression (9) below.

$$O=I\times N/(OL+IL) \quad (9)$$

"360" in Expression (11) is a value obtained by performing correction using the white point (0.8) on a gradation value (G=225) indicated by an input signal and then multiplying the corrected gradation value by N (N=2). Thus, when OL represents the intensity of external light (G(OL)=0.8), IL represents the intensity of the internal light $L_1$ (G(IL)=0.61), I represents the gradation value (G=225) indicated by the input signal, and O represents an output gradation value (O(G)=255) of a pixel, the signal processing unit 80 calculates the output gradation value based on Expression (9) below.

$$O=I\times N/(OL+IL) \quad (9)$$

"128" in Expression (12) is a value obtained by performing correction using the white point (0.8) on a gradation value (B=160) indicated by an input signal and then multiplying the corrected gradation value by N (N=2). Thus, when OL represents the intensity of external light (B(OL)=0.8), IL represents the intensity of the internal light $L_1$ (B(IL)=0.61), I represents the gradation value (B=160×0.8=128) indicated by the input signal, and O represents an output gradation value (O(B)=91) of a pixel, the signal processing unit 80 calculates the output gradation value based on Expression (9) below.

$$O=I\times N/(OL+IL) \quad (9)$$

The white point is the ratio of a plurality of colors constituting white to be reproduced by a combination (for example, RGB) of a plurality of colors. Thus, the signal processing unit 80 corrects the gradation value indicated by the input signal using the ratio of a plurality of colors constituting white to be reproduced by a combination of a plurality of colors, and then calculates the output gradation value of each pixel based on Expression (1). Although correction using the white point (1) is performed on the gradation value (R=180) indicated by the input signal in calculation of Expression (10), the correction generates no change in the gradation value. Therefore, the gradation value is not actually corrected (R=180×1=180).

As described above, the signal processing unit 80 performs calculation of the gradation values indicated by the output signals for the sub-pixels using Expressions (6) to (8) on the unit pixels 45 belonging to the partial region. Thus, the signal processing unit 80 determines the gradation values of the unit pixels 45 belonging to the partial region of one unit of processing in the same manner of the processing at Step S8.

The signal processing unit 80 performs processing similar to the processing described above for each unit of processing. Accordingly, the signal processing unit 80 determines the intensity of the internal light $L_1$ of each of all light emitting regions included in the light source unit 50, determines a gradation value indicated by an output signal for each of sub-pixels belonging to each of all partial regions included in the display unit 10, and determines the intensity of the internal light $L_1$ of each of all light emitting regions included in the light source unit 50. In this manner, the signal processing unit 80 sets one partial region as a predetermined image display region, calculates the required luminance value of one light emitting region corresponding to the one partial region, determines the intensity of the internal light $L_1$ emitted from the one light emitting region, and calculates the output gradation value of each pixel 48 included in the one partial region.

FIG. 18 is a diagram illustrating an example of control of the internal light $L_1$ and calculation of the gradation value for each unit of processing. The external light $L_2$ is the same for all units of processing. FIG. 18 illustrates a case in which the intensity of external light is (R(OL), G(OL), B(OL))=(1, 0.8, 0.8). In each of the unit $U_1$ of processing and the unit $U_2$ of processing illustrated in FIG. 18, the required luminance value of (Rt, Gt, Bt)=(360, 360, 128) is obtained based on input signals for unit pixels 45 included in each unit of processing. Accordingly, the intensity of the internal light $L_1$ is "0.61" for the unit $U_1$ of processing and the unit $U_2$ of processing as described above with reference to FIGS. 17 to 20. As illustrated in FIG. 18, the required luminance value of (Rt, Gt, Bt)=(360, 128, 128) of a unit $U_3$ of processing is obtained based on input signals for unit pixels 45 included in the unit $U_3$ of processing. Accordingly, R(FL)=0.41, G(FL)=0, and B(FL)=0 are satisfied in the unit $U_3$ of processing. Therefore, FLMAX=0.41 is obtained, and thus the intensity of the internal light $L_1$ for the unit $U_3$ of processing is "0.41". As illustrated in FIG. 18, the required luminance value of (Rt, Gt, Bt)=(200, 128, 128) of a unit $U_4$ of processing is obtained based on input signals to a plurality of unit pixels 45 included in the unit $U_4$ of processing. Accordingly, R(FL)=0, G(FL)=0, and B(FL)=0 are satisfied in the unit $U_4$ of processing. Therefore, FLMAX=0 is obtained, and thus the intensity of the internal light $L_1$ for the unit $U_4$ of processing is "0". In this manner, according to the present embodiment, the light emitting unit 51 provided for each unit of processing can be individually controlled with the intensity of the internal light $L_1$ necessary for the unit of processing. Although FIG. 18 lists the required luminance value and the intensity of the internal light $L_1$ for the four units of processing ($U_1$, $U_2$, $U_3$, and $U_4$), the signal processing unit 80 performs processing individually for any other unit of processing through the same mechanism.

Figures 19, 20:
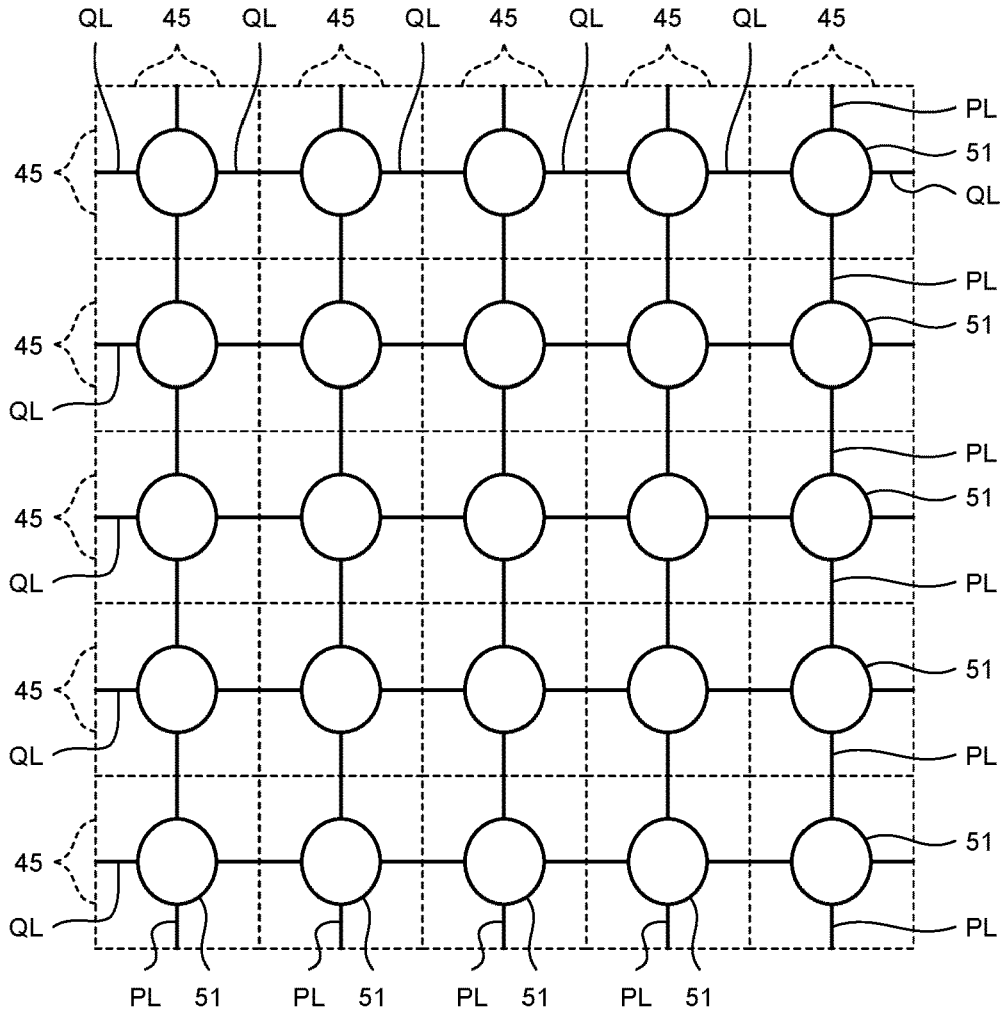
FIG. 19 is a diagram illustrating exemplary calculation of gradation values of a plurality of unit pixels included in one unit of processing.
FIG. 20 is a diagram illustrating an exemplary positional relation between one partial region and a light emitting unit belonging to one light emitting region that irradiates the one partial region with light.

FIG. 19 is a diagram illustrating exemplary calculation of gradation values of a plurality of unit pixels included in one unit of processing. FIG. 19 illustrates a case in which the intensity of external light is (R(OL), G(OL), B(OL))=(1, 0.8, 0.8). The required luminance values (Rt, Gt, Bt) of unit pixels 45 included in the unit $U_1$ of processing are (360, 360, 128), (300, 300, 100), (200, 200, 50), (100, 100, 25), (50, 50, 0), and so on. The signal processing unit 80 calculates gradation values for these required luminance values in accordance with the intensity of the incoming light L based on the intensity of external light (R(OL), G(OL), B(OL))=(1, 0.8, 0.8) and the intensity of the internal light $L_1$ (0.61) of the unit $U_1$ of processing using Expressions (6) to (8). Accordingly, as illustrated in FIG. 19, gradation values indicated by output signals for the unit pixels 45 are (O(R), O(G), O(B))=(223, 255, 91), (186, 213, 71), (124, 141, 35), (62, 71, 18), (31, 35, 0), and so on. FIG. 19 illustrates the case of the unit $U_1$ of processing, but the signal processing unit 80 performs processing individually on any other unit of processing through the same mechanism.

Deviation in frame between output (light emission) from the light emitting region and output of an image performed by the display unit 10 is allowed as long as the deviation occurs in such a short time that cannot be visually recognized by human eyes. For example, when the display device 1 performs output of 60 frames per second (fps), human eyes cannot visually recognize delay of the timing of light emission of the light emitting region of the light source unit 50 in accordance with the intensity of the internal light $L_1$ calculated based on an input signal corresponding to the image behind the timing of image output performed by the display unit 10 by one frame, and thus this delay is allowed. Specific numerical values of fps and the number of frames are merely exemplary, and the present invention is not limited thereto. The degree of deviation in frame that is allowed between the timing of image output and the timing of light emission may be predetermined based on the numerical value of fps.

The signal processing unit 80 outputs a signal indicating a determined gradation value as an output signal to a sub-pixel. The signal processing unit 80 outputs, to the light emitting regions, signals for causing the respective light emitting regions to emit light the determined intensities of the internal light $L_1$. The display unit 10 operates each pixel 48 to achieve a light transmissivity in accordance with the gradation value indicated by the output signal. The illumination unit 20 turns on each light emitting region at a light emitting intensity in accordance with each signal.

In the first embodiment, any color space can be employed by changing the definition of white indicated by the white point, that is, the ratio of a plurality of colors constituting white. As a specific example, a measuring unit (for example, the sensor 70) measures the intensity of the color components of each of a plurality colors included in the external light $L_2$, and the signal processing unit 80 employs the ratio of the measured intensity of the color components of the first color, the second color, and the third color as the definition of the white point, that is, the ratio of the first color, the second color, and the third color constituting white. Thus, the color to be output as white can be caused to be white that is visually recognized under an irradiation condition of the external light $L_2$. In other words, by employing such a white point, a color space of the display output from the display device can be caused to be a color space under the irradiation condition of the external light $L_2$ irrespective of the ratio of the colors constituting light emitted to the display panel 30.

The definition of a color space with the white point is not limited to the ratio of the intensities of a plurality of colors in the external light $L_2$. For example, the signal processing unit 80 may equalize all values in the ratio of the colors constituting white. In other words, the signal processing unit 80 may set the ratio of the colors indicated by the definition of the white point to be 1:1: . . . :1. In the first embodiment, the internal light $L_1$ has a ratio of 1:1:1 for the color components of red (R), green (G), and blue (B), which satisfies the above condition. In the first embodiment, setting 1:1:1 to the ratio of a plurality of colors indicated by the definition of the white point can achieve a color space under illumination with the internal light $L_1$ irrespective of the ratio of colors included in light incident on the display panel 30.

In the first embodiment, the internal light $L_1$ is not used in some cases, for example, when the intensity of external light is sufficient for display output. The intensity of external light is more likely to be sufficient for display output, for example, when darker display output is intentionally set. The intensity of external light is 0 in some cases, for example, when the environment of the electronic apparatus 1 including the display device is completely dark.

The following describes, with reference to FIGS. 20 to 25, pixel luminance adjustment performed after the intensity of the internal light $L_1$ is determined for each partial region. Specifically, a color difference is potentially visually recognized near a boundary between adjacent partial regions depending on a difference in the intensity of the internal light $L_1$ between the partial regions. Thus, in the present embodiment, visual recognition of the color difference is decreased by correcting an output gradation value so that a gradual change is generated in a partial region with weaker internal light $L_1$. The description with reference to FIGS. 20 to 25 is made on matters related to the correction.

FIG. 20 is a diagram illustrating an exemplary positional relation between one partial region and the light emitting unit 51 belonging to one light emitting region that irradiates the one partial region with light. One light emitting region that irradiates one partial region including a plurality of unit pixels 45 with light includes a plurality of light emitting units 51. Specifically, as illustrated in FIG. 20, one light emitting region that irradiates one partial region including the unit pixels 45 of X×Y=10×10 with light includes the light emitting units 51 of 5× 5.

The light emitting units 51 share a signal line PL and a scanning line QL. Specifically, as illustrated in FIG. 20, a plurality of light emitting units 51 arranged along the Y direction are coupled with one signal line PL extending along the Y direction. A plurality of light emitting units 51 arranged along the X direction are coupled with one scanning line QL extending along the X direction. The signal line PL and the scanning line QL couple each light emitting unit 51 and the light-source-unit control circuit 60 through a driver (not illustrated) for controlling the light emitting intensity of the light emitting unit 51. For example, the light-source-unit control circuit 60 outputs, to each driver, a signal indicating the light emitting intensity of each light emitting unit 51 through the signal line PL. The light-source-unit control circuit 60 outputs a drive signal to the scanning line QL on which the light emitting unit 51 to be turned on is located. A driver coupled with the scanning line QL to which the drive signal is output operates the light emitting unit 51 in accordance with the signal. The signal line PL and the scanning line QL have such diameters that a user looking at an image displayed by the display device cannot visually recognize the lines.

Figure 21:
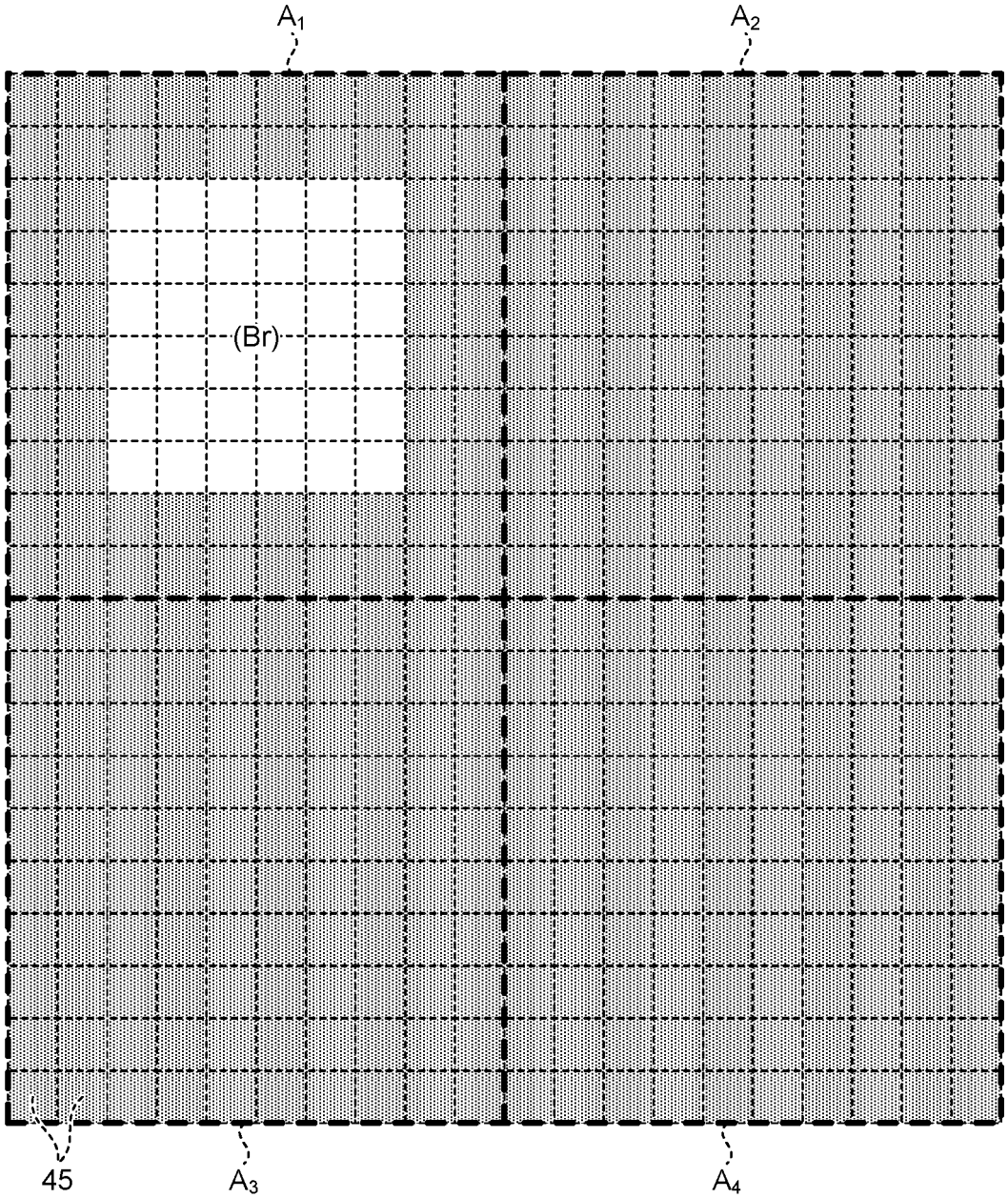
FIG. 21 is a schematic diagram illustrating exemplary output from 2×2 partial regions.
Figure 22:
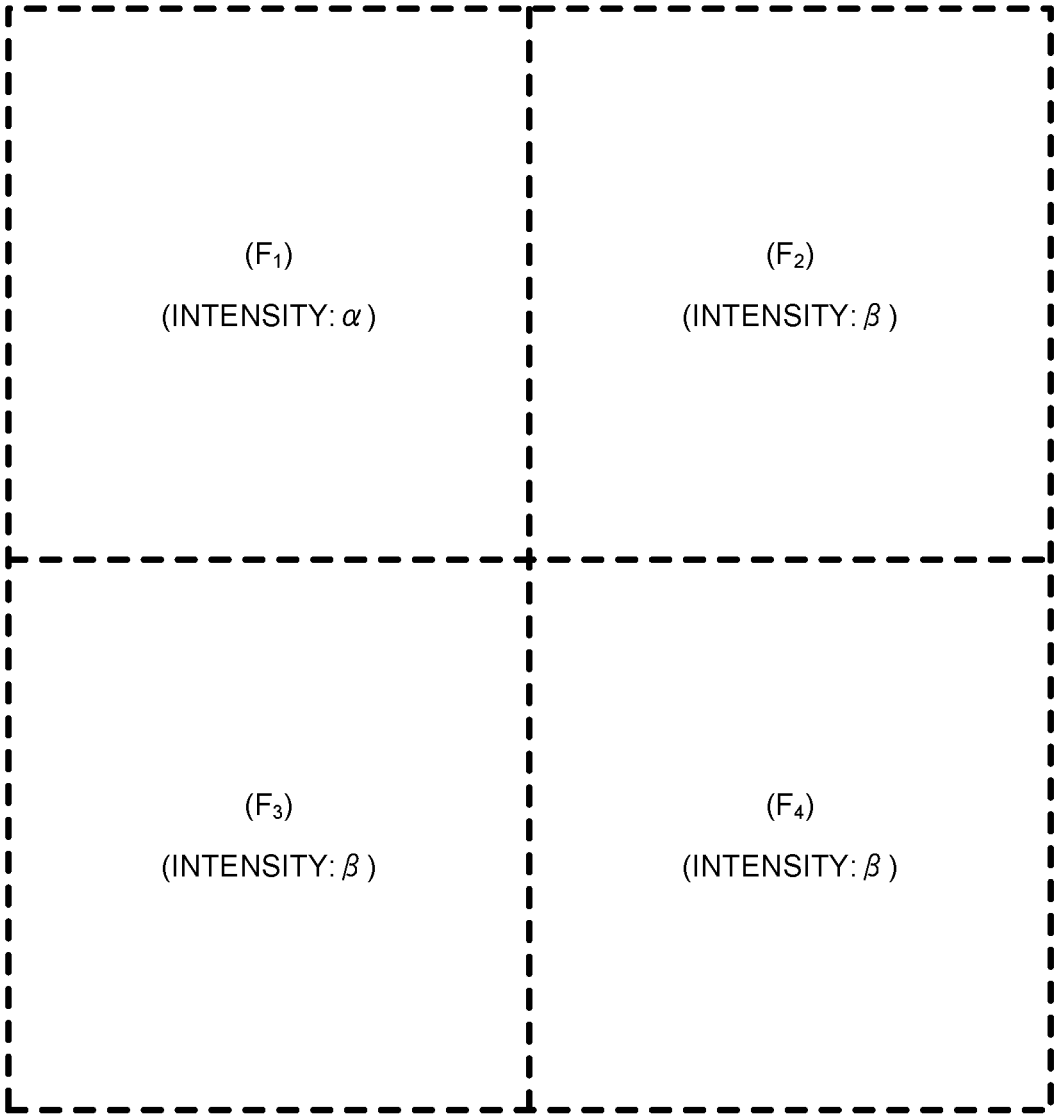
FIG. 22 is a schematic diagram illustrating an exemplary light emitting state of a plurality of light emitting regions that irradiate the 2×2 partial regions with light.

FIG. 21 is a schematic diagram illustrating exemplary output from partial regions $A_1$ to $A_4$ of 2×2. FIG. 22 is a schematic diagram illustrating an exemplary light emitting state of light emitting regions $F_1$ to $F_4$ that irradiate the partial regions $A_1$ to $A_4$ of 2×2 with light. The intensities of light ($\alpha$ or $\beta$) illustrated in FIG. 22 have the relation of $\alpha>\beta$.

As an example in which an output signal for a target pixel is adjusted to generate a gradual change, suppose that part of the partial regions includes a display region Br that is expected to output at higher luminance that requires stronger internal light $L_1$, and partial regions around the display region Br are expected to perform a predetermined output that is an output with light weaker than that of the display region Br. In the example illustrated in FIG. 21, an upper-left partial region $A_1$ among the partial regions $A_1$ to $A_4$ of 2×2 includes the display region Br. Unit pixels 45 other than the unit pixels in the display region Br in the partial region $A_1$ and all unit pixels 45 in the partial regions $A_2$ to $A_4$ around the partial region $A_1$ output black ((R, G, B)=(0, 0, 0)). The display region Br does not include outmost pixels in the partial region $A_1$.

In the example described with reference to FIG. 21, among light emitting regions that irradiate these partial regions $A_1$ to $A_4$ with light, only a light emitting region $F_1$ emits light stronger than that from the light emitting regions $F_2$ to $F_4$ around the light emitting region $F_1$ (refer to FIG. 22). The light emitting region $F_1$ irradiates the partial region $A_1$ with light, the partial region $A_1$ including the display region Br that performs output at higher luminance. As a result, when correction described later is not performed, display output of part of the unit pixels 45 expected to output an identical luminance in the partial region $A_1$ and the partial regions $A_2$ to $A_4$ may be visually recognized as an output display output at different luminance levels. Specifically, black ((R, G, B)=(0, 0, 0)) in the partial region $A_1$ irradiated with stronger light because of the display region Br is potentially visually recognized as brighter black than black ((R, G, B)=(0, 0, 0)) in the surrounding partial regions $A_2$ to $A_4$ due to the stronger light. The visual recognition of such a color difference is most significant between the unit pixels 45 adjacent in the X direction, the Y direction, and a diagonal direction across a boundary between the partial region $A_1$ and the surrounding partial regions $A_2$ to $A_4$. Thus, a color difference appears at the boundary. The larger the difference in the intensity of light between adjacent light emitting regions, the higher the possibility that the color difference is visually recognized, and further the higher the possibility that the color difference is visually recognized at a boundary between partial regions for which the intensities of light emitted from corresponding light emitting regions are different.

FIG. 22 illustrates an example in which the intensity of light from the light emitting region $F_1$ is higher than the intensities of light from the surrounding light emitting regions $F_2$ to $F_4$. The example illustrated in FIG. 22 includes, in addition to a case in which light is emitted from the light emitting region $F_1$ but not from the surrounding light emitting regions $F_2$ to $F_4$, a case in which light is emitted from all light emitting regions $F_1$ to $F_4$, and the light from the light emitting region $F_1$ is stronger.

The signal processing unit 80 corrects the gradation values of the unit pixels 45 in the partial regions $A_2$ to $A_4$ so as to decrease visual recognition of the color difference described above, when a difference in the intensity of light between adjacent light emitting regions is equal to or larger than a predetermined threshold. Specifically, the signal processing unit 80 corrects the gradation values such that, in the partial regions $A_2$ to $A_4$, the brightness gradually becomes darker from a unit pixel 45 closer to the boundary line with the partial region $A_1$ among the unit pixels 45 to a unit pixel 45 further away from the boundary line. This achieves such a gradual change that the brightness gradually becomes darker from the partial region $A_1$ to the surrounding partial regions $A_2$ to $A_4$. The correction of the brightness such as the gradual change can decrease visual recognition of the color difference.

FIG. 23 is a schematic diagram of correction to decrease visual recognition of a color difference. In the example illustrated in FIG. 23, gradation values that are input for the unit pixels 45 in the partial regions $A_1$ and $A_2$ except for the display region Br of the partial region $A_1$ indicate black ((R, G, B)=(0, 0, 0)). In other words, it should be visually recognized that all regions except for the display region Br have the same color.

In the example illustrated in FIG. 23, the external light $L_2$ and the internal light $L_1$ are incident on the partial region $A_1$ because the internal light $L_1$ in addition to the external light $L_2$ are needed for output from the display region Br. In contrast, only the external light $L_2$ is incident on the partial region $A_2$. When a difference between the intensity of light including the internal light $L_1$ and the intensity of light including no internal light $L_1$ is equal to or larger than a predetermined threshold, a difference between the brighter black in the partial region $A_1$ and the darker black in the partial region $A_2$ may be visually recognized. For this reason, as illustrated in FIG. 23, the signal processing unit 80 corrects the output gradation values for the unit pixels 45 in the partial region $A_2$ so as to increase the output gradation value of a unit pixel 45 located closer to the partial region $A_1$, so that the brightness of black in the partial region $A_2$ gradually increases with increasing proximity to the partial region $A_1$.

For example, suppose that black in the partial region $A_1$ has a brightness visually recognized as the gradation value of (R, G, B)=(e, e, e) due to the external light $L_2$ and the internal light $L_1$. In this case, the signal processing unit 80 corrects the gradation values so that the unit pixel 45 closest to the partial region $A_1$ among the unit pixels 45 in the partial region $A_2$ is visually recognized in a color equivalent to (R, G, B)=(e, e, e). The signal processing unit 80 decreases, with distance of the unit pixel 45 from the partial region $A_1$, the degree of correction in which the colors of the unit pixels 45 in the partial region $A_2$ are corrected from (R, G, B)=(0, 0, 0) toward (R, G, B)=(e, e, e). Accordingly, in the example illustrated in FIG. 23, a gradual change is provided that black has a lower brightness at a position farther away from the partial region $A_1$ in a region in a dashed line frame in the partial region $A_2$.

Although the description with reference to FIG. 23 is made on the relation between the partial region $A_1$ and the partial region $A_2$, the signal processing unit 80 performs the same correction on the output gradation value for other partial regions (for example, the partial regions $A_3$ and $A_4$) around the partial region $A_1$ in accordance with a distance from the partial region $A_1$.

The following describes specific processing related to correction on an image illustrated in FIG. 23. The signal processing unit 80 determines whether a difference in the intensity of light between adjacent light emitting regions is equal to or larger than a predetermined threshold based on, for example, the result of the processing at step S6 described above. The predetermined threshold may be any value equal to or smaller than the maximum value of a possible difference in the intensity of light, but is desirably predetermined based on the result of an experiment or the like. The experiment may be an experiment for determining whether an output of an identical color appears as different outputs (or is detected as different outputs by a sensor or the like configured to measure an output), for example, when the identical color is output from a continuous region including the unit pixels 45 near a boundary between adjacent partial regions, and the intensities of light from the light emitting regions that irradiate these partial regions are different intensities from each other.

If it is determined that the difference in the intensity of light between adjacent light emitting regions is smaller than the predetermined threshold, the signal processing unit 80 does not perform correction in accordance with the difference in the intensity of light between these light emitting regions. If it is determined that the difference in the intensity of light between adjacent light emitting regions is equal to or larger than the predetermined threshold, the signal processing unit 80 performs the correction. The description with reference to FIG. 24 is made on a case in which it is determined that the difference in the intensity of light between the light emitting region $F_1$ and the light emitting region $F_2$ is equal to or larger than the predetermined threshold. In this case, the intensity of light has such a magnitude relation that the light emitting region $F_1$> the light emitting region $F_2$.

FIG. 24 is a schematic diagram illustrating an exemplary degree of correction on a predetermined number of unit pixels 45. FIG. 24 illustrates exemplary correction on the partial region $A_2$. Each rectangle illustrated in FIG. 24 and FIG. 25 represents a unit pixel 45.

The signal processing unit 80 performs correction on the partial region $A_2$ corresponding to the light emitting region $F_2$ the intensity of light from which is lower. Specifically, the signal processing unit 80 performs correction to increase the luminance of a predetermined number of pixels located closer to the partial region $A_1$ among the unit pixels 45 included in the partial region $A_2$. In FIG. 24, the unit pixels 45 as the target of the correction are shaded.

The signal processing unit 80 performs processing to determine a correction value (hereinafter referred to as a reference value) as a reference. In the first embodiment, the reference value is predetermined in accordance with a difference in the intensity of light between adjacent light emitting regions. The reference value is, for example, a luminance increase to be obtained through the correction. This reference value is predetermined based on, for example, an experiment for checking how much the outputs (gradation value) of the unit pixels 45 in the partial region $A_2$ need to be increased so as to decrease the visual recognition of the outputs as a color different from that of the outputs of the unit pixels 45 in the partial region $A_1$, or to cause a visually recognized output difference to fall within an allowable range, for example. The signal processing unit 80 determines the reference value by reading a reference value corresponding to the difference in the intensity of light between the adjacent light emitting regions $F_1$ and $F_2$ from the storage unit. The signal processing unit 80 performs the correction on the partial region $A_2$ using the reference value. The signal processing unit 80 determines a luminance increase to be added as correction to any unit pixel 45 located within a distance of a predetermined pixel width from a boundary with the partial region $A_1$ using Expression (13) below or the like. The predetermined pixel width may be a width corresponding to five pixels, that is, a width corresponding to five unit pixels 45, for example. E in Expression (13) represents the luminance increase. H in Expression (13) represents the reference value. T in Expression (13) is a numerical value indicating the predetermined pixel width. For example, if the distance is the width corresponding to five pixels, U=5 is satisfied. U in Expression (13) represents the number of unit pixels 45 counted from the boundary with the partial region $A_1$. For example, if each partial region includes V ($1 \le V \le v$) unit pixels 45 in the X direction and W ($1 \le W \le w$) unit pixels 45 in the Y direction, the coordinates of a unit pixel 45 belonging to the partial region can be represented as (Xv, Yw). In this case, the unit pixel 45 at (X1, Yw) adjacent to the boundary with the partial region $A_1$ among the unit pixels 45 belonging to the partial region $A_2$ is the first pixel from the boundary with the partial region on which the stronger internal light $L_1$ is incident, and thus U=1. Similarly, U=V holds in this case, and the unit pixel 45 at a position that satisfies V> T+1 is not located within the predetermined pixel width and thus not to be corrected.

$$E = H \times (T - U + 1) \tag{13}$$

Expression (13) above is applied when the reference value (H) is defined as a luminance increase applied to the unit pixel 45 (for example, V=5) farthest from the partial region $A_1$ among the unit pixels 45 on which the correction is performed. However, the expression is not limited thereto, and the present invention can employ any expression for determining the luminance increase. For example, the reference value (H) may be defined as a luminance increase applied to the unit pixel 45 (for example, V=1) closest to the partial region $A_1$ among the unit pixels 45 on which the correction is performed. In this case, an expression including {(T−U+1)/T} in place of (T−U+1) in Expression (13) is used to calculate the luminance increase. The correction is performed using either expression so that the largest correction (for example, E=5) is applied to the unit pixel 45 closest to the partial region $A_1$ among the unit pixels 45 on which the correction is performed, and so that the luminance increase due to the correction decreases with distance from the partial region $A_1$, as illustrated in FIG. 24. In addition to the partial region $A_2$, the signal processing unit 80 performs the correction in a similar manner on any other partial region adjacent to the upper, lower, right, or left side of the partial region $A_1$. Specifically, the signal processing unit 80 performs, on the partial region $A_3$, the same correction as that on the partial region $A_2$. More specifically, for the partial region $A_3$, the unit pixels 45 arranged in a row on the upper side closer to the partial region $A_1$ are corrected.

FIG. 25 is a schematic diagram illustrating an exemplary degree of correction on the predetermined number of unit pixels 45. FIG. 25 illustrates exemplary correction on the partial region $A_4$. As illustrated in FIG. 25, for the partial region $A_4$ obliquely adjacent to the partial region $A_1$, the signal processing unit 80 uses Expression (14) below to determine a luminance increase to be added as correction on the unit pixels 45 in a predetermined pixel width. Xi and Yi are the numbers of the unit pixels 45 in the X and Y directions, respectively, which are counted with a starting point at the position of a corner as a boundary with the partial region $A_1$ among the unit pixels 45 belonging to the partial region $A_4$. For example, in the example illustrated in FIG. 25, (X1, Y1) denote the coordinates of the unit pixel 45 closest to the corner as the boundary with the partial regions $A_4$ and $A_1$, and (Xi, Yi)=(1, 1) is satisfied for the unit pixel 45. Thus, (Xi, Yi)=(V, W) is satisfied.

$$E=H\times(T-\sqrt{(Xi)^2+(Yi)^2}+1) \tag{14}$$

In the description above, a luminance increase applied as correction is calculated using Expressions (13) and (14), but this is an exemplary specific method of determining the luminance increase due to the correction, and the present invention is not limited thereto. For example, the signal processing unit 80 may store, in the storage unit, data used in the correction such as table data indicating distribution of a distance and the luminance increase (or the ratio (gain) of luminance increases to be added through the correction) as illustrated in FIGS. 24 and 25, the distance being a distance from a boundary with a partial region on which the stronger internal light $L_1$ is incident. In this case, the signal processing unit 80 reads the data to determine luminance increases for the predetermined number of unit pixels 45. Each numerical value in parentheses in FIG. 25 is an exemplary gain amount (value) when the table data indicates the gain. The signal processing unit performs the correction to increase the luminance value for each pixel by a value obtained by multiplying the gain amount (value) and a difference between the luminance value (the gradation value) of each pixel and the maximum luminance value (the maximum gradation value) that each pixel can take.

The signal processing unit 80 reflects a luminance increase determined as described above on the output gradation value. Specifically, the signal processing unit 80 adds a gradation value corresponding to the luminance increase to the output gradation value of a sub-pixel 48. For example, when a color before the correction is black (for example (R, G, B)=(0, 0, 0)), the signal processing unit 80 determines an increase in the gradation value of each of the sub-pixel 48R of red (R), the sub-pixel 48G of green (G), and the sub-pixel 48B of blue (B) with a ratio in accordance with the white point. In other words, when a color before the correction is black, the signal processing unit 80 performs correction to change the black toward white by increasing the luminance. When a color before the correction is a color other than black, the signal processing unit 80 increases the luminance without changing the hue and saturation of the color before the correction. In other words, the signal processing unit 80 determines increases in the gradation values of the sub-pixel 48R of red (R), the sub-pixel 48G of green (G), and the sub-pixel 48B of blue (B) so as to obtain such output gradation values that a ratio of red (R), green (G), and blue (B) indicated by an input signal before the correction is not changed.

As described above, the signal processing unit 80 reflects the luminance increase on the output gradation value. Thus, when the intensity of light incident on the partial regions $A_2$, $A_3$, and $A_4$ is 0, which means no light, display output is visually recognized as (R, G, B)=(0, 0, 0) irrespective of the luminance increase, even if the luminance increase is reflected on the output gradation value as the correction. In other words, the correction only on the output gradation value provides no visually recognizable luminance increase for a partial region with none of the internal light $L_1$ and the external light $L_2$. Such a situation occurs when all unit pixels 45 belong to the partial regions $A_2$, $A_3$, and $A_4$ before the correction have the output gradation value of (R, G, B)=(0, 0, 0).

Thus, when the intensity of light incident on the partial regions $A_2$, $A_3$, and $A_4$ is 0, the signal processing unit 80 increases the intensity of the internal light $L_1$ emitted from the light emitting regions $F_2$, $F_3$, and $F_4$ toward the intensity of the internal light $L_1$ emitted from the light emitting region $F_1$. Specifically, the signal processing unit 80 calculates the minimum intensity of the internal light $L_1$ needed for output reflecting a luminance increase added through the correction. For example, when the luminance increase is (R, G, B)=(16, 16, 16), the minimum intensity of the internal light $L_1$ is needed to be 0.0625 (=1/16). In other words, the minimum necessary intensity of the internal light $L_1$ corresponds to a value obtained by dividing a gradation value most in need for the internal light $L_1$ among the gradation values of the colors indicated by luminance increases, by the maximum value (for example, 255) of the gradation value. The signal processing unit 80 turns on the light emitting regions $F_2$, F3, and F4 at the minimum necessary intensity of the internal light $L_1$ calculated in this manner. The signal processing unit 80 extends a "gradation value indicating a luminance increase" to be added as correction on each unit pixel 45, using the reciprocal of "the minimum necessary intensity of the internal light $L_1$" thus calculated. For example, when the luminance increase is (R, G, B)=(16, 16, 16) and the minimum necessary intensity of the internal light $L_1$ is 0.0625 (=1/16), a luminance increase extended by the reciprocal (16) of the minimum necessary intensity of the internal light $L_1$ is (R, G, B)=(255, 255, 255). This obtains a luminance increase to be added through the correction.

As described with reference to FIGS. 23 to 25, in the first embodiment, when pixels (for example, the unit pixels 45) that are expected to perform display output at identical luminance are adjacent to each other in adjacent partial regions (for example, the partial region $A_1$, and the partial region $A_2$, $A_3$, or $A_4$), and when a difference in the intensity of light between light emitting regions (for example, a difference between the intensity of light from the light emitting region $F_1$, and the intensity of light from the light emitting region $F_2$, $F_3$, or $F_4$) is equal to or larger than a predetermined threshold, the signal processing unit 80 performs correction to increase the luminance of a predetermined number of pixels belonging to a first partial region (for example, the partial region $A_2$, $A_3$, or $A_4$) corresponding to a first light emitting region (for example, the light emitting region $F_2$, $F_3$, or $F_4$) the intensity of the internal light from which is lower, among the adjacent partial regions.

The predetermined number of pixels are pixels that are expected to perform display output at "identical luminance" (for example, black) described above, and pixels located closer to a partial region corresponding to a second light emitting region (for example, the light emitting region $F_1$) the intensity of the internal light $L_1$ from which is higher. When the partial region $A_1$ and the partial region $A_2$, $A_3$, or $A_4$ each include unit pixels 45 that are expected to perform output of an "identical color (for example, black)", there is a possibility that the "identical color" output from the partial region $A_1$ and the "identical color" output from the partial region $A_2$, $A_3$, or $A_4$ are visually recognized as different colors due to a difference in the intensity of light between the light emitting region $F_1$ and the light emitting region $F_2$, $F_3$, or $F_4$. Therefore, the signal processing unit 80 performs correction on the predetermined number of pixels to lower the possibility. In FIGS. 24 and 25, shaded unit pixels 45 represent the predetermined number of pixels.

Figure 26:
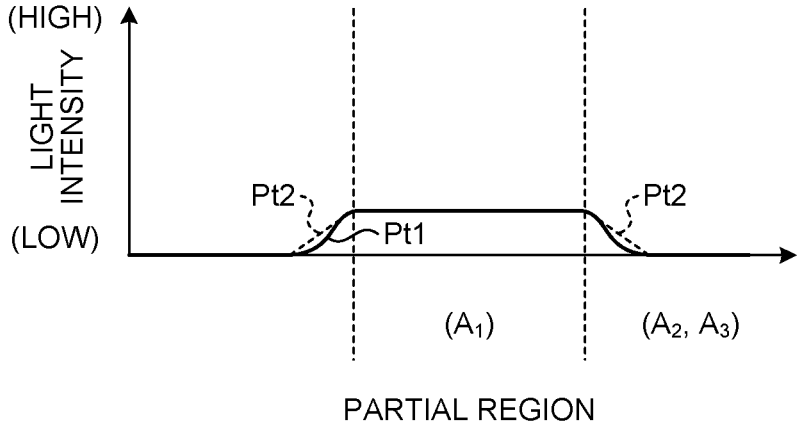
FIG. 26 is a schematic diagram illustrating an exemplary intensity distribution of light from one light emitting region.

FIG. 26 is a schematic diagram illustrating an exemplary intensity distribution of light from one light emitting region. In the first embodiment, when correction is performed on one partial region, light emitted from light emitting regions to partial regions adjacent to the one partial region may be taken into consideration. Specifically, for example, when light (the internal light $L_1$) is emitted from the light emitting region $F_1$, the light of the light emitting region $F_1$ has an intensity distribution in which the light arrives at the partial regions $A_2$ and $A_3$ adjacent to the partial region $A_1$ corresponding to the light emitting region $F_1$ in some cases. FIG. 26 only illustrates an example of light from the light emitting region $F_1$ and incident on the partial regions $A_1$, $A_2$, and $A_3$, but the same situation occurs also when partial regions adjacent to upper and left sides of the partial region $A_1$ exist. Hereinafter, as in the example illustrated in FIG. 26, the partial regions $A_2$ and $A_3$ at which light emitted from the light emitting region $F_1$ to the adjacent partial region $A_1$ arrives are also referred to as arrival regions, and this light is also referred to as arrival light.

The arrival light attenuates in accordance with a distance from a light emitting region. As illustrated in FIG. 26, the arrival light has a curved attenuation pattern Pt1 larger than a linear attenuation pattern Pt2 proportional to the distance. The curved attenuation pattern Pt1 has a larger change in the luminance than that of the linear attenuation pattern Pt2, and thus when the partial region $A_1$ and the arrival regions (partial regions $A_2$ and $A_3$) are performing output at output gradation values corresponding to identical luminance, luminance in the partial region $A_1$ appears to be higher than the identical luminance in some cases. In other words, a part of display outputs performed at the output gradation values corresponding to the identical luminance by adjacent partial regions may be visually recognized as display output at different luminance from the other display outputs. In such a case, in the first embodiment, the signal processing unit 80 may perform correction with the arrival light taken into account.

Figure 27:
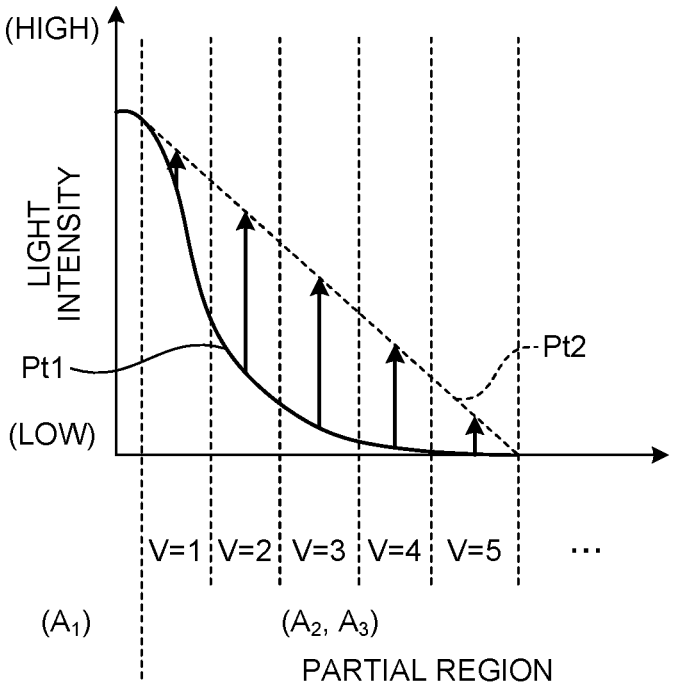
FIG. 27 is a schematic diagram illustrating exemplary correction with arrival light taken into account.

FIG. 27 is a schematic diagram illustrating exemplary correction with the arrival light taken into account. The curved attenuation pattern Pt1 of the arrival light is the attenuation pattern of the arrival light before reflection at each unit pixel 45 in an arrival region. Thus, gentle attenuation of light after reflection at an arrival region can be achieved by performing correction to increase the light transmissivity of the unit pixel 45 at a distance causing a larger attenuation. Accordingly, for example, as illustrated in FIG. 27, the curved attenuation pattern Pt1 of the arrival light before the reflection can be corrected to the linear attenuation pattern Pt2 after the reflection. This can achieve a gentle attenuation pattern in accordance with a distance from a light emitting region, thereby decreasing visual recognition of a difference in the luminance between a partial region corresponding to the light emitting region and the arrival region. Specifically, the signal processing unit 80 performs extension processing to increase the output gradation values of pixels that are included in the unit pixels 45 belonging to the arrival region and irradiated with the arrival light exhibiting a larger degree of light attenuation with the distance from the light emitting region. The pixels on which the extension processing is performed may be, for example, the unit pixels 45 in a width corresponding to five pixels represented by V=1 to 5 in FIG. 27. The increase in the output gradation values means that the degree of increase in the gradation values through the extension processing of the unit pixels 45 depends on the degree of correction on the attenuation pattern. The signal processing unit 80 corrects the output gradation values so that, for example, the arrival light after the reflection exhibits the linear attenuation pattern Pt2. This is, however, exemplary, and the present invention is not limited thereto and may be modified as appropriate. The intensity distribution in the light emitting region and a specific degree of extension are determined based on data (arrival light related data) obtained through, for example, an experiment in which the intensity distribution of the light emitting region is measured to determine the degree of extension, and are stored in, for example, the storage unit. Although the description with reference to FIGS. 26 and 27 is made on the intensity distribution of light emitted from one light emitting region, the signal processing unit 80 performs the correction based on the intensity distribution individually on each light emitting region. As described above, the signal processing unit 80 performs the correction based on the distribution of the intensity of the internal light $L_1$ emitted from each light emitting region.

The attenuation pattern as illustrated in FIG. 26 described above is an example when the light emitting unit 51 belonging to one light emitting region emits light uniform in all directions toward the display surface of the display unit 10. The arrival light have different attenuation patterns between arrival regions depending on a condition such as the position of the light emitting unit 51 belonging to the light emitting region in some cases. Correction data for the arrival light may be produced based on the difference in the attenuation pattern of the arrival light in accordance with such a condition.

Figure 28:
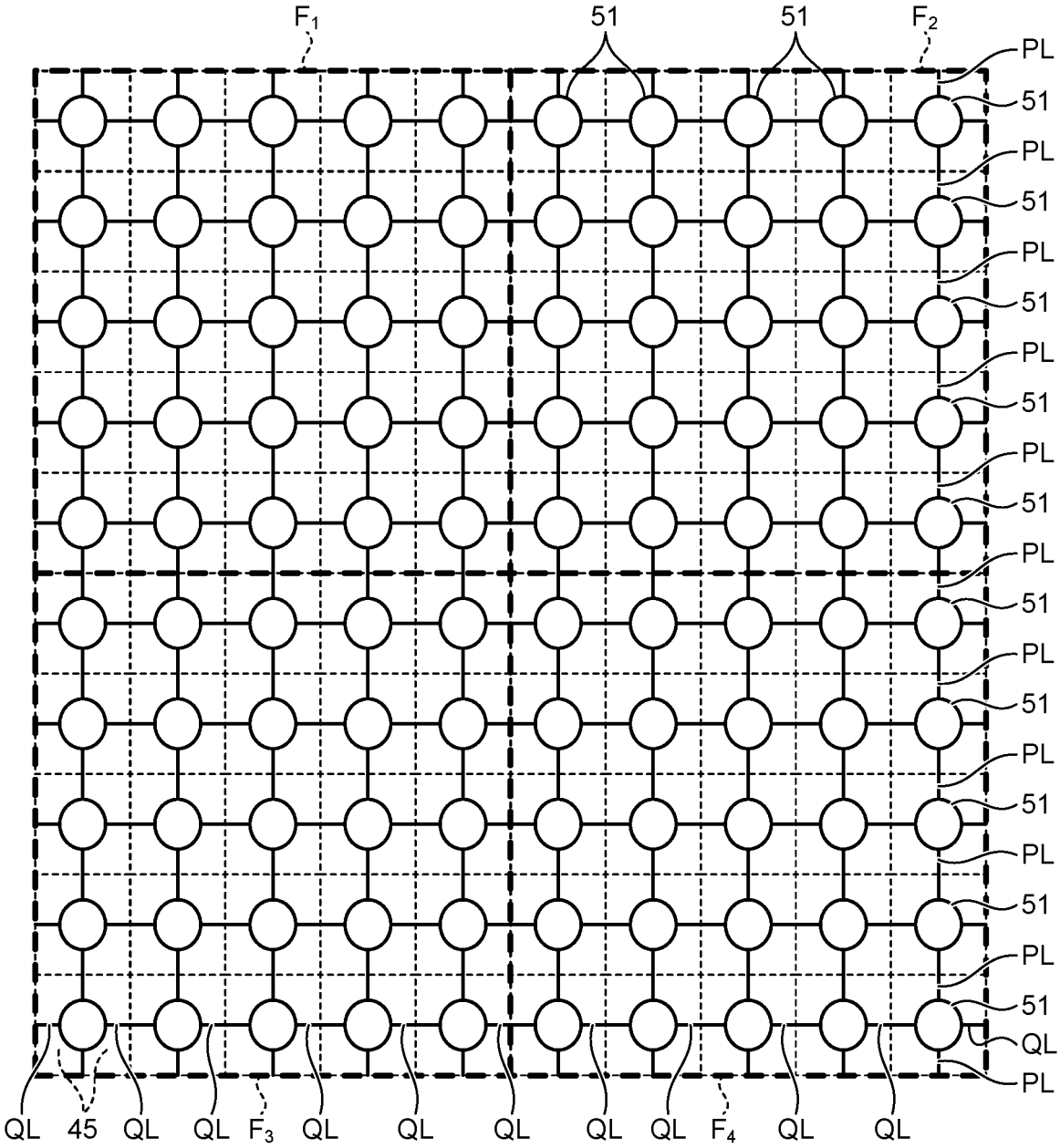
FIG. 28 is a diagram illustrating an exemplary arrangement pattern of a plurality of light emitting units belonging to one light emitting region.
Figure 29:
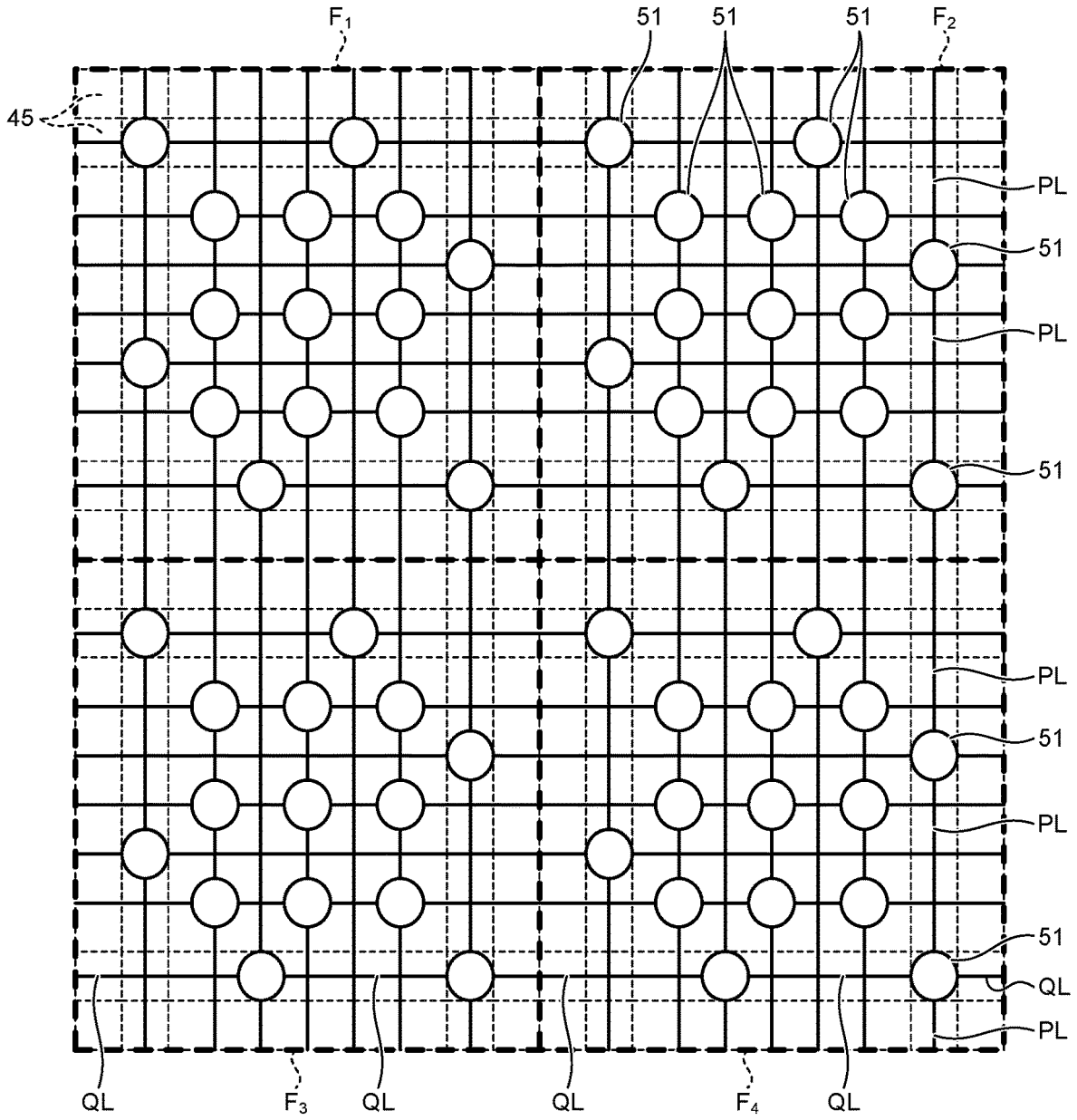
FIG. 29 is a diagram illustrating an exemplary arrangement pattern of a plurality of light emitting units belonging to one light emitting region.
Figure 30:
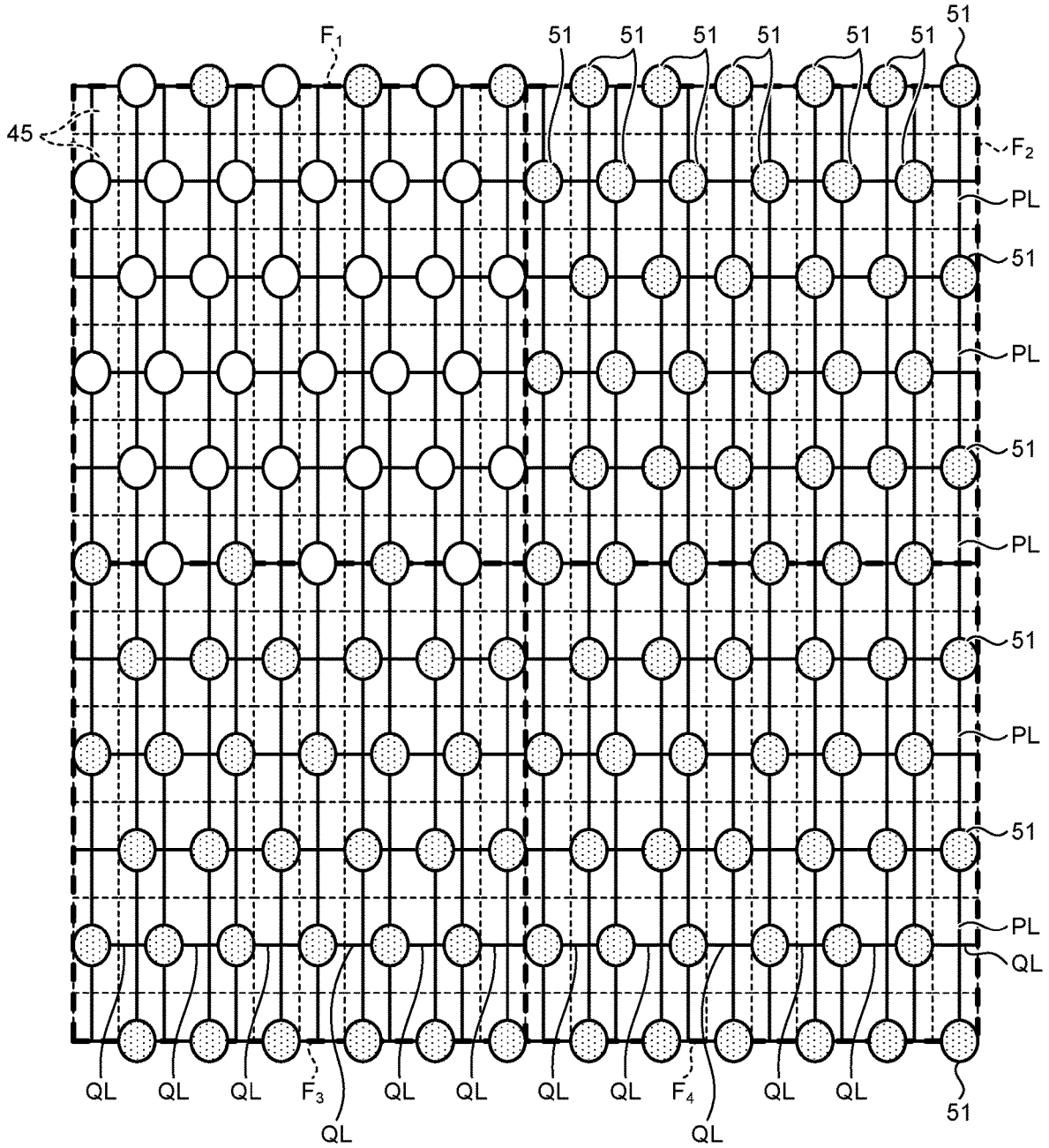
FIG. 30 is a diagram illustrating an exemplary arrangement pattern of a plurality of light emitting units belonging to one light emitting region.
Figure 31:
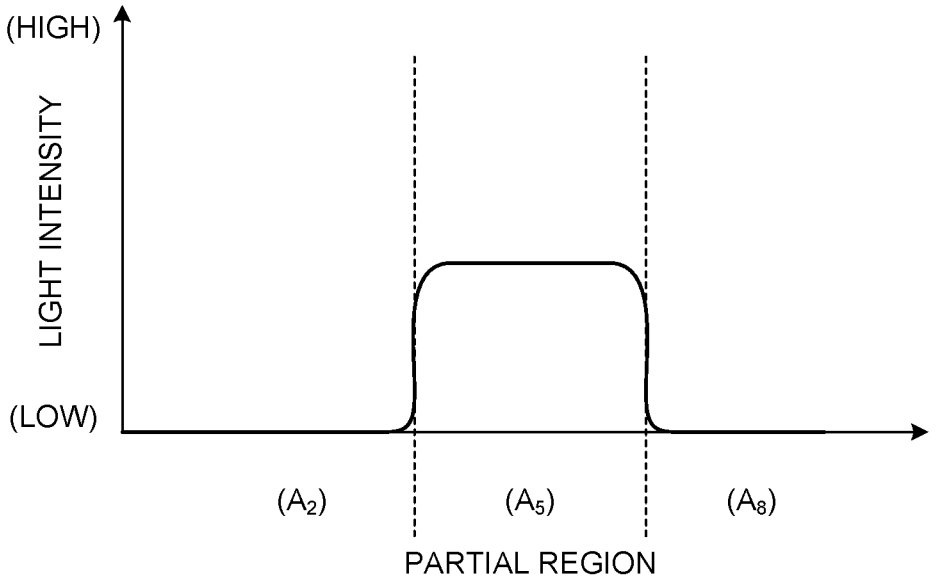
FIG. 31 is a diagram illustrating an example of ranges in which light arrives from the one light emitting region illustrated in FIG. 28 and an example of an attenuation pattern of the intensity of arrival light.
Figure 32:
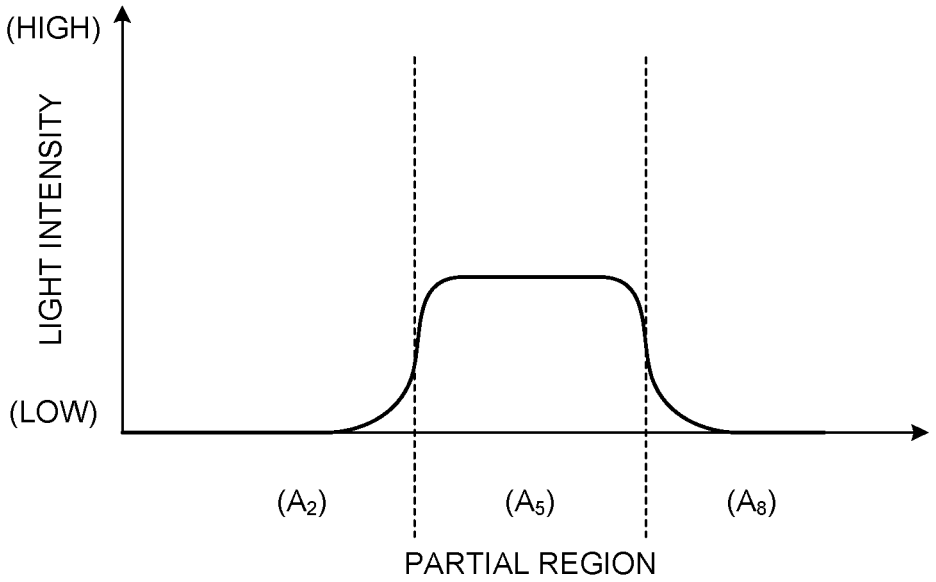
FIG. 32 is a diagram illustrating an example of ranges in which light arrives from the one light emitting region illustrated in FIG. 29 and an example of an attenuation pattern of the intensity of arrival light.
Figure 33:
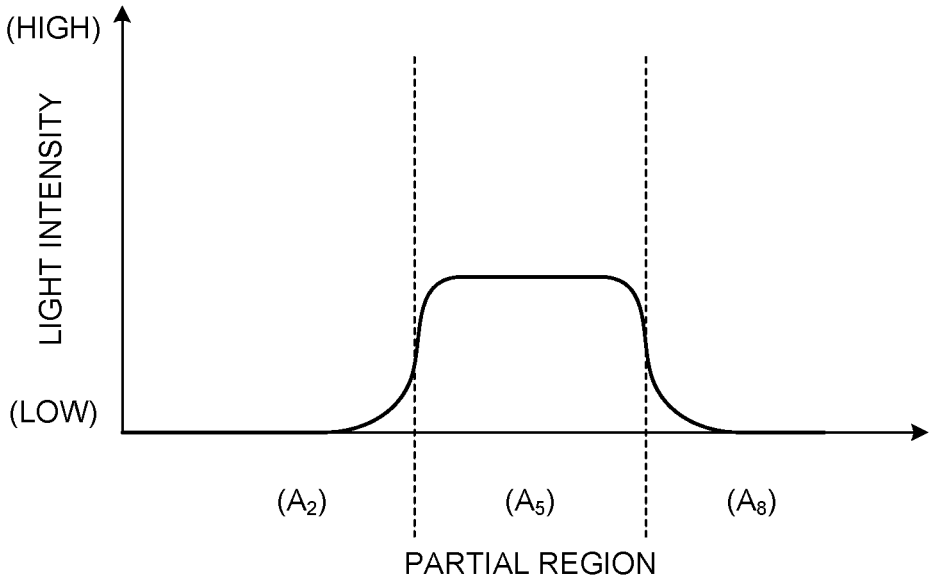
FIG. 33 is a diagram illustrating an example of ranges in which light arrives from the one light emitting region illustrated in FIG. 30 and an example of an attenuation pattern of the intensity of arrival light.

FIGS. 28, 29, and 30 are each a diagram illustrating an exemplary arrangement pattern of a plurality of light emitting units 51 belonging to one light emitting region. Each circle in FIGS. 28, 29, and 30 represents a light emitting unit 51, and each region enclosed by dashed lines represents one light emitting region. FIGS. 31, 32, and 33 are each a diagram illustrating an example of ranges in which light arrives from the one light emitting region illustrated in FIG. 28, 29, or 30 and an example of an attenuation pattern of the intensity of the arrival light. FIGS. 31, 32, and 33 each illustrate the intensity of light when only the light emitting region $F_1$ emits light. As illustrated in the examples in FIGS. 28 and 29 and FIGS. 31 and 32, the smaller the arrangement interval of the light emitting units 51 provided on peripheral edge sides of the light emitting region is, the more abruptly the arrival light attenuates with the distance. Thus, a gentler attenuation pattern of the intensity of the arrival light can be achieved as illustrated in FIG. 32 by adjusting the arrangement interval of the light emitting units 51 provided on peripheral edge sides of the light emitting region as illustrated in FIG. 30. This can decrease visual recognition of a difference in the luminance between a partial region corresponding to the light emitting region and an arrival region.

However, the arrangement interval of the light emitting units 51 is desirably smaller in a central part of the light emitting region than that on the peripheral edge sides, so as to achieve further reduction in the unevenness of light in planar light emission from the light emitting region. Therefore, the arrangement interval of the light emitting units 51 provided along the peripheral edges among a plurality of light emitting units 51 belonging to the light emitting region is set to be larger than the arrangement interval of the light emitting units 51 in the central part of the light emitting region as illustrated in FIG. 29. Thus, a light emitting pattern having a smaller unevenness and decreasing visual recognition of a difference in the luminance between a partial region corresponding to the light emitting region and an arrival region can be achieved. In addition, a further reduced unevenness of light simultaneously emitted from adjacent light emitting regions can be achieved by arranging the light emitting units 51 along peripheral edges of the adjacent light emitting regions in a staggered pattern as illustrated in FIG. 29.

The light emitting units 51 may be provided on a boundary line between adjacent light emitting regions. In this case, when the two light emitting regions sharing the light emitting units 51 provided on the boundary line simultaneously emit light, all light emitting units 51 on the boundary line are turned on. When only one of the two light emitting regions emits light, as illustrated in FIG. 30, every other light emitting unit 51 on the boundary line is turned on, and each light emitting unit 51 between the turned light emitting units 51 is not turned on. A gentler attenuation pattern of the intensity of the arrival light can be achieved as illustrated in FIG. 33 by controlling the operation of the light emitting unit 51 in this manner. This can decrease visual recognition of a difference in the luminance between a partial region corresponding to a light emitting region and an arrival region. In FIG. 30, any light emitting unit 51 not turned on is shaded.

Although the description above is made on the example in which the "predetermined number of pixels" as the target of correction for the signal processing unit 80 are some pixels belonging to the partial regions $A_2$, $A_3$, and $A_4$, the "predetermined number of pixels" may be all pixels in these partial regions. The intensity of light from any one or more of the light emitting regions $F_2$, $F_3$, and $F_4$ may be increased if needed to achieve a reduced difference in the luminance between the partial region $A_1$ and the partial region $A_2$, $A_3$, or $A_4$ when the external light $L_2$ is not 0 but is, for example, insufficient in correction. In this case, for example, the "predetermined threshold" described above is set as a first threshold, and a second threshold different from the first threshold is set separately. If a difference in the intensity of light between adjacent light emitting regions is equal to or larger than the second threshold, the signal processing unit 80 may increase the intensity of light from a light emitting region the intensity of the internal light $L_1$ from which is lower based on the difference in the intensity of light.

In the first embodiment, correction to increase the luminance of a predetermined number of pixels belonging to the first partial region of the adjacent partial regions is performed. This can decrease visual recognition of a difference in the output luminance caused by a difference in the intensity of light between adjacent light emitting regions.

In addition, correction to increase the luminance of pixels closer to a second partial region among the predetermined number of pixels to be higher than the luminance of pixels on a farther side is performed. Therefore, a gentler change of a difference in the luminance caused by a distance farther from the second light emitting region can be achieved. This can decrease visual recognition of a difference in the output luminance caused by a difference in the intensity of light between adjacent light emitting regions.

In addition, performing correction for display output of black at identical luminance can reduce generation of a state in which part of a region in which the display output of black is performed appears to be floating due to a difference in the intensity of light between light emitting regions.

In addition, when correction on visual recognition is difficult only through correction on the output gradation value, increasing the intensity of the internal light $L_1$ of the first light emitting region to be closer to the intensity of the internal light $L_1$ of the second light emitting region can decrease visual recognition of a difference in the output luminance caused by a difference in the intensity of light between adjacent light emitting regions.

In addition, when the intensity of the internal light $L_1$ of the first light emitting region is 0, light necessary for correction can be obtained by increasing the intensity of the internal light $L_1$ of the first light emitting region to be closer to the intensity of the internal light $L_1$ of the second light emitting region. Thus, visual recognition of a difference in the output luminance caused by a difference in the intensity of light between adjacent light emitting regions can be decreased when correction on the visual recognition is difficult only through correction on the output gradation value.

In addition, correction based on a distribution of the intensity of the internal light $L_1$ emitted from each light emitting region enables correction using the internal light $L_1$ from a light emitting region the intensity of the internal light $L_1$ from which is higher.

In addition, display output can be performed at a brightness in accordance with the intensity of external light. In addition, the signal processing unit 80 sets one partial region as a predetermined image display region, calculates the required luminance value of one light emitting region corresponding to the partial region, determines the intensity of the internal light $L_1$ emitted from the light emitting region, and calculates the output gradation value of each pixel 48 included in the partial region, thereby performing control to emit light from each light emitting region at the intensity of the internal light $L_1$ necessary for the corresponding partial region. This allows reduction of the quantity of light emitted from a light emitting region corresponding to a partial region for which compensation with the internal light $L_1$ is unnecessary or a partial region that is sufficiently irradiated with light at a lower intensity, when output from part of the partial regions is bright. Thus, the electric power consumption can be further reduced.

The pixels 48 each serve as a sub-pixel that outputs any one of a plurality of colors, and the display unit 10 combines output from the sub-pixels, thereby performing color reproduction, for example. Thus, display output can be performed at the brightness corresponding to the intensity of external light also in color output.

In the embodiment, the gradation values indicated by the input signal are corrected using the ratio (white point) of a plurality of colors constituting white that is reproduced by the combination of the colors. Thus, color reproduction can be performed in a desired color space.

In the embodiment, the ratio of measured intensities of color components of a plurality of colors is set to be the ratio of the colors constituting white. Thus, color reproduction can be performed under the illumination condition with the external light alone independently of the ratio of the colors constituting light with which the display panel 30 is irradiated.

All values of the ratio of a plurality of colors constituting white are equalized. This allows color reproduction in a color space in which all values of the ratio of the plurality of colors constituting white are identical, even when values of the ratio of colors included in light incident on the display panel 30 are not equal to each other.

The pixels 48 each serve as a sub-pixel that outputs any one of the colors of R, G, and B. The display unit 10 combines output from the sub-pixel 48R for R, the sub-pixel 48G for G, and the sub-pixel 48B for B, thereby performing color reproduction based on RGB signals. Thus, it is possible to minimize the load of the conversion of colors in the processing for generating the output signal from the input signal, for example.

When IL>0 is satisfied, the required luminance value is calculated so that the output gradation value of a pixel 48 that performs output at the highest gradation value among the pixels 48 included in a predetermined image display region is a gradation value that makes the light transmissivity maximum, thereby minimizing compensation with the internal light $L_1$ and achieving desired luminance.

Second Embodiment

The following describes a second embodiment of the present invention. The same configuration as that of the first embodiment is denoted by the same reference sign, and description thereof will be omitted.

Figure 34:
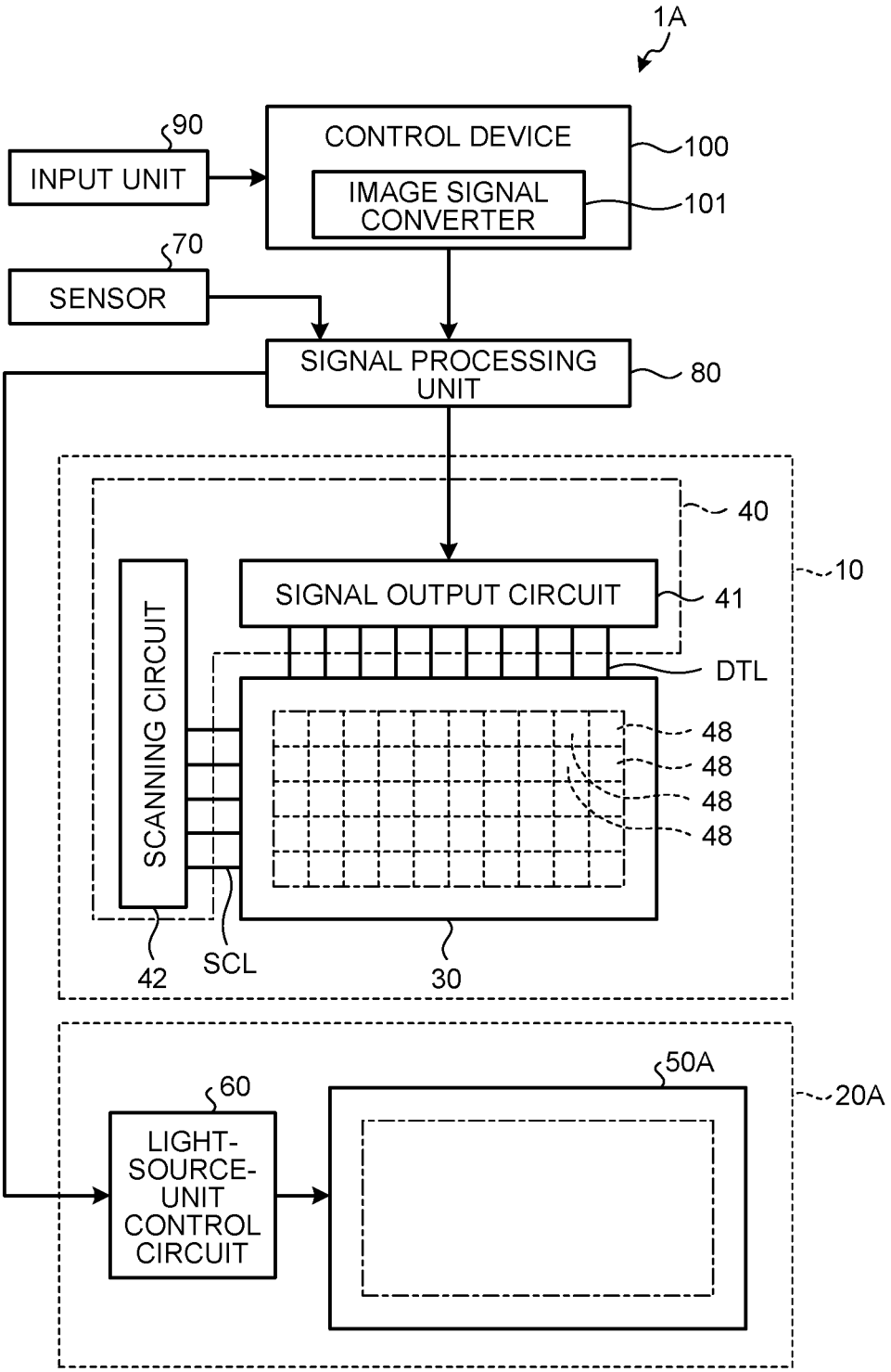
FIG. 34 is a block diagram of an exemplary main configuration of an electronic apparatus including a display device according to a second embodiment.
Figure 35:
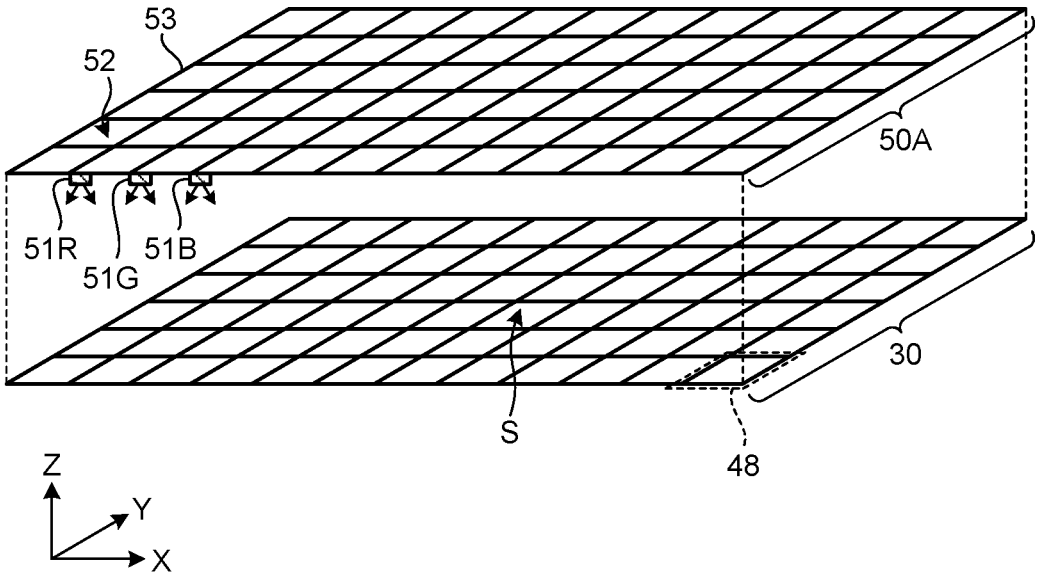
FIG. 35 is an exploded perspective view schematically illustrating the display device according to the second embodiment.

FIG. 34 is a block diagram of an exemplary main configuration of an electronic apparatus 1A including a display device according to the second embodiment. FIG. 35 is an exploded perspective view schematically illustrating the display device according to the second embodiment. The electronic apparatus 1A in the second embodiment includes an illumination unit 20A in place of the illumination unit 20 in the first embodiment. The illumination unit 20A includes, for example, a light source unit 50A and the light-source-unit control circuit 60. The light source unit 50A is arranged facing the display surface S of the display panel 30. The light source unit 50A is a front light that irradiates the display surface S of the display panel 30 with the internal light $L_1$. The light source unit 50A includes a first light source 51R that irradiates the display unit 10 with light in a first color, a second light source 51G that irradiates the display unit 10 with light in a second color, and a third light source 51B that irradiates the display unit 10 with light in a third color. The first light source 51R, the second light source 51G, and the third light source 51B are each, for example, a self light emitting element provided on a translucent substrate. The translucent substrate may be made of, for example, glass or any of various plastic materials (for example, PMMA, polycarbonate resin, acrylic resin, amorphous polypropylene resin, and styrene resin including AS resin). The first light source 51R, the second light source 51G, and the third light source 51B are each, for example, an organic electroluminescence (EL) element, an inorganic EL element, an organic light emitting diode (OLED), or a micro light emitting diode (MicroLED). The first light source 51R, the second light source 51G, and the third light source 51B each irradiate the display surface S of the display panel 30 with light. The first light source 51R, the second light source 51G, and the third light source 51B are each a light source that emits light in a first color (for example, red (R)), a second color (for example, green (G)), or a third color (for example, blue (B)). The first light source 51R, the second light source 51G, and the third light source 51B may be each, for example, an OLED provided for the color of emitted light to emit light in the individual color, or a light emitting element provided to emit light through a color filter corresponding to the color of emitted light.

FIG. 36 is a schematic diagram of exemplary correction in the second embodiment. In the example illustrated in FIG. 36, gradation values input to the unit pixels 45 in the partial regions $A_1$ and $A_2$ indicate black ((R, G, B)=(0, 0, 0)), except for a display region Rr of the partial region $A_1$. In other words, it should be visually recognized that all regions except for the display region Br have the same color. In the display region Br, Rf>0 and Gf=Bf=0 are satisfied. In other words, the display region Rr is a region in which the compensation required luminance exceeds 0 for light in red and the internal light $L_1$ is need for light in red but not for light in green and blue.

In the example illustrated in FIG. 36, the internal light $L_1$ is needed in red (R) in addition to the external light $L_2$ for output of the display region Rr, and thus the external light $L_2$ and the internal light $L_1$ in red (R) are incident on the partial region $A_1$. In contrast, only the external light $L_2$ is incident on the partial region $A_2$. When a difference between the intensity of light including the internal light $L_1$ and the intensity of light including no internal light $L_1$ is equal to or larger than a predetermined threshold, a difference between more reddish black in the partial region $A_1$ and less reddish black in the partial region $A_2$ may be visually recognized. For this reason, as illustrated in FIG. 36, the signal processing unit 80 corrects the output gradation values for the unit pixels 45 in the partial region $A_2$ so as to increase the output gradation value for red(R) of a unit pixel 45 located closer to the partial region $A_1$, so that the redness in black in the partial region $A_2$ gradually increases with increasing proximity to the partial region $A_1$.

For example, suppose that black in the partial region $A_1$ has a brightness visually recognized as the gradation value of (R, G, B)=(j, 0, 0) due to the intensity of light including the external light $L_2$ and the internal light $L_1$ in red (R). In this case, the signal processing unit 80 performs such correction that the unit pixel 45 closest to the partial region $A_1$ among the unit pixels 45 in the partial region $A_2$ is visually recognized in a color equivalent to (R, G, B)=(j, 0, 0). The signal processing unit 80 decreases, with distance of the unit pixel 45 from the partial region $A_1$, the degree of correction in which the colors of the unit pixels 45 in the partial region $A_2$ are corrected from (R, G, B)=(0, 0, 0) toward (R, G, B)=(j, 0, 0). Accordingly, in the example illustrated in FIG. 36, a gradual change is provided that black has weaker red at a position farther away from the partial region $A_1$ in a region in a dashed line frame in the partial region $A_2$.

Figures 38, 39:
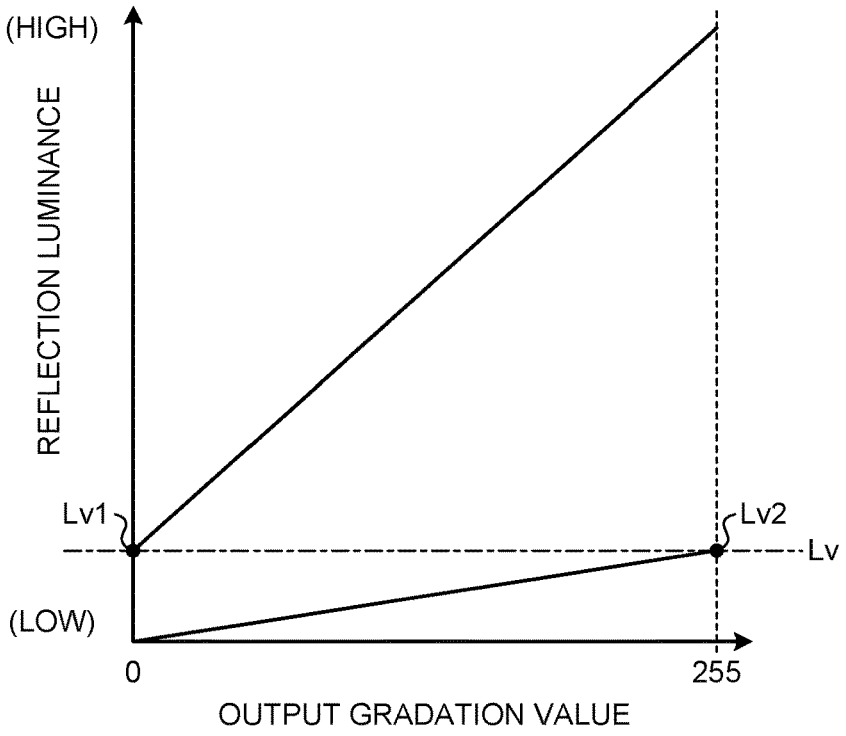
FIG. 38 is a schematic diagram illustrating an example in which a first light emitting region that is not turned on in FIG. 37 is turned on for correction.
FIG. 39 is a graph illustrating an exemplary comparison between the reflection luminance of a first partial region and the reflection luminance of a second partial region.

FIG. 37 is a schematic diagram illustrating an example in which a light source of one color is turned on only in one of two adjacent light emitting regions. FIG. 38 is a schematic diagram illustrating an example in which a first light emitting region that is not turned on in FIG. 37 is turned on for correction. FIG. 39 is a graph illustrating an exemplary comparison between the reflection luminance of a second partial region and the reflection luminance of a first partial region. In the second embodiment, the intensity of light in each color can be controlled to increase the intensity of light from the first light emitting region in correction. Specifically, for example, as illustrated in FIG. 37, when a light source (for example, the first light source 51R) of one color is turned on only in the light emitting region $F_1$ as one of the two adjacent light emitting regions $F_1$ and $F_2$, the determination using the second threshold finds that a condition for performing correction is met. In this case, the light emitting region $F_2$, which has not been turned on, is turned on to emit the internal light $L_1$ for correction as illustrated in FIG. 38. Specifically, the signal processing unit 80 turns on a light source corresponding to the color the light source of which is turned on in the light emitting region $F_1$, among the first light source 51R, the second light source 51G, and the third light source 51B belonging to the light emitting region $F_2$. the signal processing unit 80 determines the intensity of light of the light source to be turned on (for example, the first light source 51R) through correction so that when, among the sub pixels 48 in the partial region $A_2$ corresponding to the light emitting region $F_2$, a sub-pixel (for example, the red sub-pixel 48R) corresponding to a color of a light source to be turned on is set to have a gradation value at the maximum output (for example, R=255), the luminance of the color in the partial region $A_2$ is the same as that of the color of the partial region $A_1$.

More specifically, assume that image output in which only the region Rr in the partial region $A_1$ as one of the two partial regions $A_1$ and $A_2$ illustrated in FIG. 37 outputs red, and in which the other regions output a background color of black. In this case, the partial region $A_1$ is irradiated with light from the first light source 51R. In contrast, the partial region $A_2$ is not irradiated with light. Accordingly, a boundary may be generated between the partial regions depending on the intensity of light incident on the partial region $A_1$ from the first light source 51R, and thus correction is needed. When it is difficult to perform output adjustment only with correction on the output gradation value, such as when the external light $L_2$ is 0, the signal processing unit 80 turns on the first light source 51R in the light emitting region $F_2$ in correction. In this case, the signal processing unit 80 sets reference luminance to be the luminance of the first color (Lv1 in FIG. 39) generated through irradiation of each unit pixel 45 in black in the partial region $A_1$ with light from the first light source 51R, and turns on the first light source 51R in the light emitting region $F_2$. In other words, the signal processing unit 80 determines the intensity of light (R=Lv) from the first light source 51R in the light emitting region corresponding to the partial region $A_1$ so that the luminance of the first color (Lv2 in FIG. 39) is the same as the reference luminance when the output gradation value of the sub-pixel 48R of red (R) included in each unit pixel belonging to the partial region $A_2$ is set to the maximum (for example, R=255). Lv=0 holds when the intensity of the external light $L_2$ is sufficient and the internal light $L_1$ is not necessary for correction.

Figure 40:
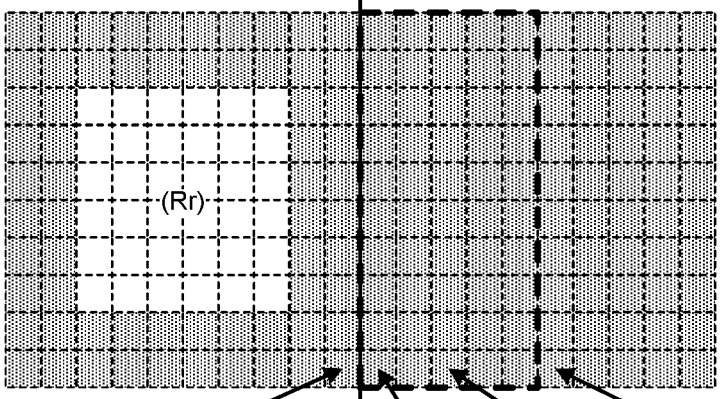
FIG. 40 is a schematic diagram of another exemplary correction in the second embodiment.

FIG. 40 is a schematic diagram of another exemplary correction in the second embodiment. In the example illustrated in FIG. 40, in the same manner as the example illustrated in FIG. 36, gradation values input for the unit pixels 45 in the partial regions $A_1$ and $A_2$ indicate black ((R, G, B)=(0, 0, 0)), except for the display region Rr of the partial region $A_1$. In the example illustrated in FIG. 40, assume a condition in which the external light $L_2$ cannot be obtained completely, unlike the example illustrated in FIG. 36. The internal light $L_1$ in red (R) is needed for output of the display region Rr, and thus the partial region $A_1$ is irradiated with the internal light $L_1$ in red (R). In addition, when the partial region $A_1$ is not irradiated with the internal light $L_1$ in other colors, reddish black is obtained in the partial region $A_1$.

The partial region $A_2$ does not need light for output of black ((R, G, B)=(0, 0, 0)). However, black in the partial region $A_1$ is reddish as described above, and thus a difference in black due to a difference in the intensity of the red may be visually recognized in some cases. When the difference between the intensity of light including the internal light $L_1$ and the intensity of light including no internal light $L_1$ is equal to or larger than a predetermined threshold.

In the example illustrated in FIG. 40, the external light $L_2$ is not obtained as described above. The internal light $L_1$ is not necessary for output of black ((R, G, B)=(0, 0, 0)), and thus the partial region $A_2$ is not irradiated with the internal light $L_1$. In other words, the partial region $A_2$ is not irradiated with light completely. Under such a condition, correction on the output gradation value of the unit pixel 45 included in the partial region $A_2$ does not change a color visually recognized in the partial region $A_2$. In such a case, only the first light source 51R of the light emitting region $F_2$ may be operated to irradiate the partial region $A_2$ with the intensity of light (R=Lv) from the first light source 51R of the light emitting region $F_2$ as described with reference to FIG. 38, but a gradual change may be achieved by a different method. The following describes the different method.

Assume that black in the partial region $A_1$ has a brightness visually recognized as the gradation value of (R, G, B)=(j, 0, 0) due to the intensity of the internal light $L_1$ in red (R). In this case, the signal processing unit 80 calculates the intensity of light (R=Lv) from the first light source 51R in the light emitting region $F_2$. The signal processing unit 80 outputs a command (light emitting region control signal) to turn on the second light source 51G and the third light source 51B in the light emitting region $F_1$ at the calculated intensity of light (Lv). The signal processing unit 80 corrects the gradation value of the unit pixel 45 of black ((R, G, B)=(0, 0, 0)) in the partial region $A_1$ to (R, G, B)=(0, 255, 255). Accordingly, as illustrated in FIG. 40, black in the partial region $A_1$ has a brightness visually recognized as the gradation value of (R, G, B)=(j, j, j). In other words, light of green (G) and blue (B) is emitted from the light emitting region $F_1$ at the same intensity as the intensity of light (R=Lv) of red (R) from the light emitting region $F_2$ that is set in accordance with the influence (0→j) of the light of red (R) from the light emitting region $F_1$ on the unit pixel 45 in black, and the output gradation value of the unit pixel in black is set to the maximum for colors (green (G) and blue (B)) other than red (R), thereby removing the red from the reddish black to achieve black at a brightness in accordance with the magnitude of the value of j.

The signal processing unit 80 also outputs commands (light emitting region control signal) to turn on the first light source 51R, the second light source 51G, and the third light source 51B of the light emitting region $F_2$. This allows black visually recognized in the partial region $A_2$ to be corrected in the range of (R, G, B)=(0, 0, 0) to (j, j, j). The signal processing unit 80 corrects the output gradation value of the unit pixel 45 to the partial region $A_1$ among the unit pixels 45 in the partial region $A_2$ to be (R, G, B)=(255, 255, 255) to achieve visual recognition as (R, G, B)=(j, j, j). The signal processing unit 80 decreases, with distance of the unit pixel 45 from the partial region $A_1$, the degree of correction in which the colors of the unit pixels 45 in the partial region $A_2$ are corrected from (R, G, B)=(0, 0, 0) toward (R, G, B)=(j, j, j). This provides, in a region in a dashed line frame in the partial region $A_2$, such a gradual change that the brightness of black is lower at a position farther away from the partial region $A_1$.

The description according to the second embodiment is exemplarily made on the first light source 51R configured to emit light of the first color (for example, red (R)), but the same mechanism as described above is applicable to the other colors. When light sources of a plurality of colors are simultaneously turned on, the signal processing unit 80 individually controls the intensity of light of each color through the same mechanism as described above. The description according to the second embodiment is made on the relation between the partial region $A_1$ and the partial region $A_2$, but the signal processing unit 80 performs the same correction on the output gradation value in accordance with a distance from the partial region $A_1$ also for other partial regions around the partial region $A_1$.

According to the second embodiment, in addition to the effect of the first embodiment, the minimum necessary light is emitted from the first light source 51R, the second light source 51G, and the third light source 51B so as to correct visual recognition when it is difficult to correct the visual recognition only through the correction on the output gradation value.

Modification

Figure 41:
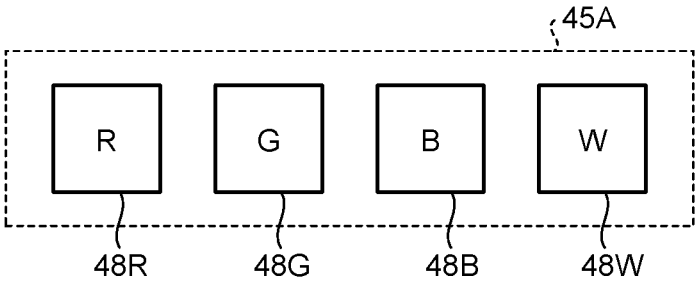
FIG. 41 is a diagram illustrating an exemplary unit of color reproduction performed by a plurality of pixels serving as sub-pixels in a modification.

The following describes a modification according to the present invention. FIG. 41 is a diagram illustrating an exemplary unit of color reproduction performed by a plurality of pixels 48 serving as sub-pixels in the modification. In the modification, each pixel 48 serves as a sub-pixel that outputs one of a plurality of colors, and the display panel 30 performs color reproduction by combining outputs from the sub-pixels. Specifically, in the modification, each pixel 48 serves as a sub-pixel that outputs one of red (R), green (G), blue (B), and white (W), and the display panel 30 performs color reproduction in accordance with an input signal by combining outputs from the sub-pixel 48R of red (R), the sub-pixel 48G of green (G), the sub-pixel 48B of blue (B), and a sub-pixel 48W of white (W). In the modification, in place of the unit pixels 45 in the embodiments described above, the display panel 30 includes a plurality of unit pixels 45A each including one sub-pixel 48R of red (R), one sub-pixel 48G of green (G), one sub-pixel 48B of blue (B), and one sub-pixel 48W of white (W).

Figure 42:
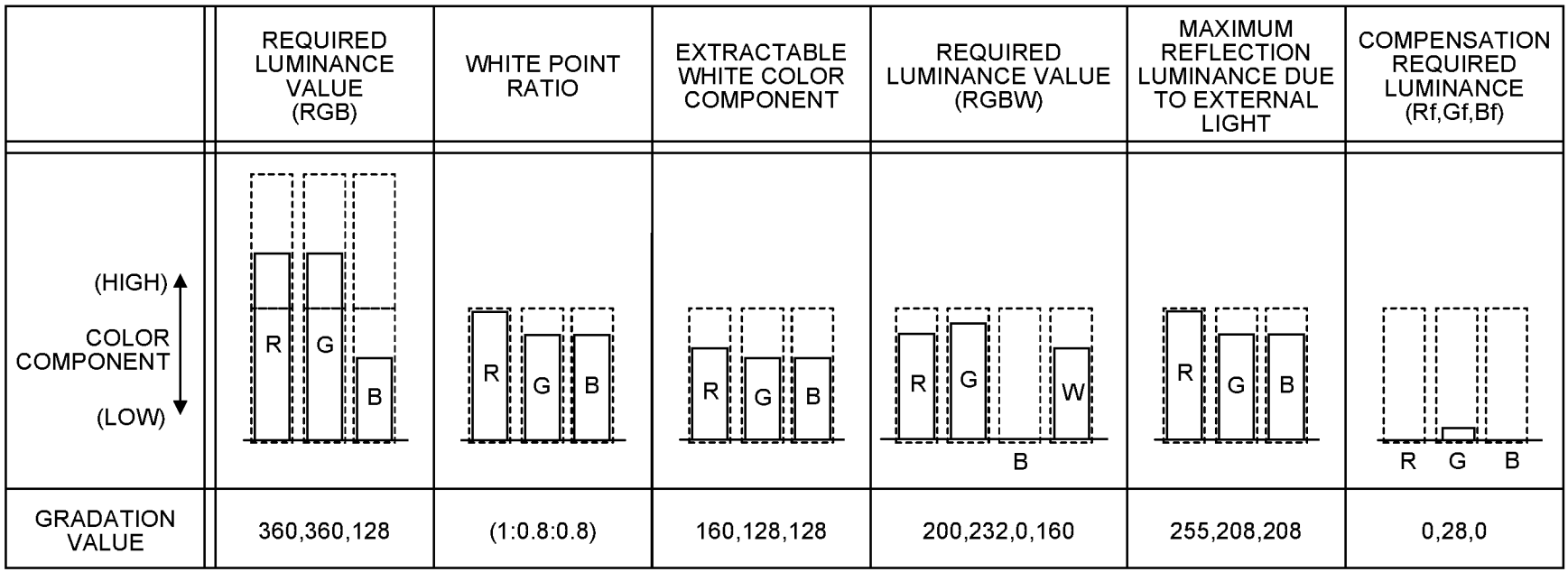
FIG. 42 is a schematic diagram illustrating exemplary calculation of the compensation required luminance in the modification.

FIG. 42 is a schematic diagram illustrating exemplary calculation of the compensation required luminance in the modification. In the modification, after the required luminance value (refer to FIG. 14) is calculated in the analysis processing, the color components in accordance with the ratio of the color components constituting white defined by the white point (refer to FIG. 13) are extracted as the luminance (gradation value) of the sub-pixel 48W of white (W). Specifically, the color components (for example, (R, G, B)=(255, 204, 204) illustrated in FIG. 13) constituting white defined by the white point are set to the maximum white luminance (W=255). The signal processing unit 80 extracts an extractable white component from the required luminance value based on the ratio of the color components constituting white defined by the white point. For example, for (R, G, B)=(255, 204, 204) illustrated in FIG. 13, the ratio of the color components constituting white is red (R):green (G):blue (B)=1:0.8:0.8. As illustrated in FIG. 42, when the color components of the required luminance value are (R, G, B)=(360, 360, 128), the color components extractable as the components of white based on red (R):green (G):blue (B)=1:0.8:0.8 are (R, G, B)=(160, 128, 128), which corresponds to W=160. In this case, the signal processing unit 80 replaces (R, G, B)=(160, 128, 128) with W=160, sets the value of W as the gradation value of the sub-pixel 48W of white (W), and subtracts gradation values extracted as the components constituting white from the gradation values of red (R), green (G), and blue (B). As a result, the gradation values of the unit pixel 45A having the color components of the required luminance value of (R, G, B)=(360, 360, 128) as an RGB signal are converted into (R, G, B, W)=(200, 232, 0, 160) as an RGBW signal. Thus, when the maximum luminance of the color components the display output of which can be performed with the external light $L_2$ is (R, G, B)=(255, 208, 208), only the color component of green (G) needs the internal light $L_1$ (Gf=24). In this manner, the signal processing unit 80 in the modification replaces the required luminance value calculated based on the RGB signal of the input signal in the analysis processing with the RGBW signal.

The signal processing unit 80 subtracts the maximum luminance of the color components that can be output with the external light $L_2$ from the required luminance values after the replacement with the RGBW signal, and sets the remaining luminance (compensation required luminance) of the color components as luminance to be compensated with the internal light $L_1$. The subsequent processing in the analysis processing according to the modification is the same as that in the embodiments described above. More specifically, the signal processing unit 80 calculates the intensity of the internal light $L_1$ for compensating a luminance deficiency for each color component using Expressions (2), (3), and (4) described above. The signal processing unit 80 performs processing to turn on the light emitting unit 51 in accordance with the maximum intensity of the calculated intensities of the internal light $L_1$ necessary for the color components. The maximum intensity (FLMAX) of the internal light $L_1$ is calculated using, for example, Expression (5) described above.

The signal processing unit 80 performs extension processing to produce an output signal as an RGBW signal by: extracting, as the gradation value of the sub-pixel 48W of white (W) of the unit pixel 45A, color components corresponding to the ratio of the color components constituting white defined by the white point from among the color components of the unit pixel 45A indicated by the gradation values of red (R), green (G), and blue (B) calculated using Expressions (6) to (8) described above in the processing at step S8; and subtracting values corresponding to component amounts extracted as the gradation value of the sub-pixel 48W of white (W), from the gradation values of red (R), green (G), and blue (B). Details of the processing of replacing the color components of red (R), green (G), and blue (B)

with the color component of white are the same as those of the processing of replacement with an RGBW signal in the analysis processing described with reference to FIG. 42. As described above, in the modification, the signal processing unit 80 performs the processing of replacing an RGB signal with an RGBW signal. A specific configuration according to the modification is the same as the specific configuration in the embodiments described above except for any property otherwise stated.

According to the modification, the pixels 48 each serve as a sub-pixel that outputs one of red (R), green (G), blue (B), and white (W), and the display panel 30 performs color reproduction by combining outputs of the sub-pixel 48R of red (R), the sub-pixel 48G of green (G), the sub-pixel 48B of blue (B), and the sub-pixel 48W of white (W). The gradation values corresponding to components convertible into white in the color components of R, G, and B indicated by the RGB signal are defined as the gradation value of the sub-pixel 48W of white (W). Thus, the color components convertible into white can be converted into white to be output. This can facilitate a further increase in the luminance by the sub-pixel 48W of white (W) and reduce compensation with the internal light $L_1$ by luminance increased by the sub-pixel 48W of white (W). Thus, the modification can achieve a further reduced electric power consumption, thereby minimizing compensation with the internal light $L_1$ and achieving desired luminance.

In the modification, when pixels (for example, the unit pixels 45A) that are expected to perform display output at identical luminance are adjacent to each other in adjacent partial regions, and when a difference in the intensity of light between light emitting regions provided to irradiate these partial regions with light is equal to or larger than a predetermined threshold, the signal processing unit 80 can perform correction to increase the luminance of a predetermined number of pixels among pixels belonging to a partial region corresponding to a light emitting region the intensity of the internal light $L_1$ from which is lower among the adjacent partial regions. The predetermined number of pixels are expected to perform display output at the identical luminance and located closer to a partial region corresponding to a light emitting region the intensity of the internal light $L_1$ from which is higher among the adjacent partial regions. In the modification, a gradation value for increasing the luminance through correction may be allocated to the sub-pixel 48W of white (W). In the modification, the intensity of light from a light emitting region the intensity of the internal light $L_1$ from which is lower may be increased as appropriate in correction.

The above description of the embodiments and the modification of the present invention do not limit the present invention. The above-described components include any component easily be thought of by the skilled person in the art, effectively identical, or equivalent. The above-described components may be combined as appropriate. Various kinds of omission, replacement, and modification of components may be performed without departing from the scope of the above-described embodiments and modification.

For example, when the display unit 10 performs monochrome display, the dispersion function of the sensor 70 may be omitted. When the display unit 10 performs monochrome display, the processing of calculations of the required luminance value, the intensity of the internal light $L_1$ from a light emitting region and a gradation value indicated by an output signal is processing for a single color (monochrome), which can be performed using expressions for any one of colors.

Although a plurality of units of processing are set in the above-described embodiments and modification, the entire effective display region included in the display unit 10 may be set as one unit of processing. In other words, the predetermined image display region included in the display unit 10 may be the entire effective display region included in the display unit 10. In this case, the illumination unit 20 may omit a function related to individual control on each light emitting region. The predetermined image display region is not limited to these described examples, but may be freely predetermined in the effective display region included in the display unit 10.

What is claimed is:

1. A display device comprising:

a display panel including a front substrate, a back substrate, a liquid crystal material layer arranged between the front substrate and the back substrate, and a plurality of pixels;

a front light that faces the display panel at a position close to the front substrate and that irradiates the display panel with light, a travelling direction of the light that comes from the front light being from the front substrate to the back substrate;

a sensor that measures intensity of external light as part of light incident on the display panel, the external light being light other than internal light emitted from the front light; and an integrated circuit that controls intensity of the internal light and respective gradation values of the pixels based on the intensity of the external light measured by the sensor, wherein a display region of the display panel includes a plurality of partial regions each including a plurality of pixels, each of the pixels includes a reflective electrode provided at the back substrate and arranged to reflect corresponding light coming from the front light for said each of the pixels, the front light includes a plurality of light emitting regions, the light emitting regions being provided to irradiate the respective partial regions with light using a plurality of light emitters corresponding to each of the light emitting regions, the integrated circuit is configured to:

determine the intensity of the internal light for each of the light emitting regions; and in a case where the partial regions include a non-light-emitting partial region for which corresponding ones of the light emitters do not emit light, pixels that are expected to perform display output at identical luminance are adjacent to each other in adjacent partial regions, and a difference in the intensity of the internal light between light emitting regions corresponding to the adjacent partial regions is equal to or larger than a predetermined threshold, perform correction to increase luminance of a predetermined number of pixels that belong to the non-light-emitting partial region in one of the adjacent partial regions and that are located close to a boundary with another of the adjacent partial regions.

2. The display device according to claim 1, wherein the display output at the identical luminance is display output of black.

3. The display device according to claim 1, wherein the pixels include at least a sub-pixel of a first color, a sub-pixel of a second color, and a sub-pixel of a third color, the sensor measures intensities of color components of the first color, the second color, and the third color included in external light, the light emitting regions are each provided to individually control the intensities of light of the first color, the second color, and the third color, and the integrated circuit individually determines the intensity of internal light necessary for display output of each of the partial regions for each of the first color, the second color, and the third color, and individually performs the correction on each of the first color, the second color, and the third color.

4. The display device according to claim 1, wherein the light emitting regions include a first light emitting region and a second light emitting region corresponding to the adjacent partial regions, the intensity of the internal light from the first light emitting region being lower than the intensity of the internal light from the second light emitting region, and the integrated circuit increases the intensity of the internal light from the first light emitting region toward the intensity of the internal light from the second light emitting region.

5. The display device according to claim 1, wherein the light emitting regions include a first light emitting region and a second light emitting region corresponding to the adjacent partial regions, the intensity of the internal light from the first light emitting region being lower than the intensity of the internal light from the second light emitting region, and the integrated circuit increases the intensity of the internal light from the first light emitting region toward the intensity of the internal light from the second light emitting region when the intensity of the external light and the intensity of the internal light from the first light emitting region before the correction are 0.

6. The display device according to claim 1, wherein the integrated circuit performs the correction based on distribution of the intensity of the internal light emitted from each of the light emitting regions.

7. The display device according to claim 1, wherein the integrated circuit performs correction to increase the luminance of the predetermined number of pixels in the non-light-emitting partial region as the pixels approach the boundary.

* * * * *